US010672357B2

(12) United States Patent
Lee et al.

(10) Patent No.: US 10,672,357 B2
(45) Date of Patent: Jun. 2, 2020

(54) GATE DRIVING CIRCUIT AND DISPLAY APPARATUS INCLUDING THE SAME

(71) Applicant: Samsung Display Co., Ltd., Yongin-si (KR)

(72) Inventors: Jae Hoon Lee, Seoul (KR); Soo-Yeon Lee, Hwaseong-si (KR); Seok Ha Hong, Seoul (KR); Bong Hyun You, Seongnam-si (KR); Jai-Hyun Koh, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 54 days.

(21) Appl. No.: 15/801,951

(22) Filed: Nov. 2, 2017

(65) Prior Publication Data

US 2018/0130435 A1 May 10, 2018

(30) Foreign Application Priority Data

Nov. 2, 2016 (KR) ..... 10-2016-0145322

(51) Int. Cl.
*G09G 3/36* (2006.01)

(52) U.S. Cl.
CPC ..... *G09G 3/3677* (2013.01); *G09G 2310/08* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 8,754,674 | B2 | 6/2014 | Lee et al. | |
| 2013/0113772 | A1* | 5/2013 | Kang | G09G 3/20 345/211 |
| 2014/0055436 | A1* | 2/2014 | Han | G09G 3/3696 345/211 |
| 2015/0206500 | A1* | 7/2015 | Kim | G09G 3/3696 345/215 |
| 2015/0269879 | A1 | 9/2015 | Shang | |
| 2016/0042806 | A1* | 2/2016 | Ogawa | G11C 19/28 345/205 |

(Continued)

FOREIGN PATENT DOCUMENTS

| | | |
|---|---|---|
| KR | 1020140131137 | 11/2014 |
| KR | 101573460 | 12/2015 |

(Continued)

*Primary Examiner* — Benjamin X Casarez
(74) *Attorney, Agent, or Firm* — Cantor Colburn LLP

(57) ABSTRACT

A stage of a gate driving circuit includes: a first control transistor diode-connected between a first input end of the stage and a first node, biased by a first input signal, and back-biased by a second input signal; a second control transistor including a control end which receives a third input signal, a first end connected to the first node, and a second end connected to a first voltage, and back-biased by a fourth input signal; a first output transistor including a control end connected to the first node, a first end connected to a clock input end of the stage, and a second end connected to a first output end of the stage; and a capacitor connected between the control and second ends of the first output transistor. The second input signal and the fourth input signal have enable levels during different periods.

16 Claims, 17 Drawing Sheets

(56) References Cited

U.S. PATENT DOCUMENTS

| | | | | |
|---|---|---|---|---|
| 2016/0064424 | A1* | 3/2016 | Umezaki | H01L 29/7869<br>257/43 |
| 2016/0203786 | A1* | 7/2016 | Lim | G09G 3/20<br>345/211 |
| 2017/0018241 | A1* | 1/2017 | Park | G09G 3/3677 |
| 2017/0193949 | A1* | 7/2017 | Kim | G09G 3/3677 |
| 2017/0206826 | A1* | 7/2017 | Kong | G09G 3/2092 |

FOREIGN PATENT DOCUMENTS

| | | | | |
|---|---|---|---|---|
| KR | 20170008348 A * | 1/2017 | | G09G 3/3677 |
| KR | 1020170008348 | 1/2017 | | |

* cited by examiner

GATE DRIVING CIRCUIT AND DISPLAY APPARATUS INCLUDING THE SAME

This application claims priority to Korean Patent Application No. 10-2016-0145322, filed on Nov. 2, 2016, and all the benefits accruing therefrom under 35 U.S.C. § 119, the content of which in its entirety is herein incorporated by reference.

BACKGROUND

(a) Field

The disclosure relates to a gate driving circuit and a display device including the gate driving circuit, and more particularly, to a gate driving circuit with improved display quality and a display device including the gate driving circuit.

(b) Description of the Related Art

A display device typically includes a plurality of gate lines, a plurality of data lines, and a plurality of pixels that are connected to the plurality of gate lines and the plurality of data lines. The display device may further include a gate driving circuit that provides gate signals to the plurality of gate lines and a data driving circuit that provides data signals to the plurality of data lines.

The gate driving circuit may include a shift register that includes a plurality of driving stage circuits (hereinafter will be referred to as driving stages). The plurality of driving stages output gate signals that respectively correspond to the plurality of gate lines. Each of the plurality of driving stages includes a plurality of transistors that are organically connected to each other.

A driving characteristic of some transistors among the plurality of transistors may be changed such that reliability of the gate driving circuit is deteriorated, and a current is leaked through the transistor such that an image may not be normally displayed in the display device.

SUMMARY

In such a display device, driving characteristics of some transistors among the plurality of transistors therein may be changed such that reliability of the gate driving circuit is deteriorated, and a current may be leaked through some transistors such that an image may not be normally displayed.

Exemplary embodiments relate to a gate driving circuit that compensates a change of a threshold voltage of some of transistors therein, and a display device including the gate driving circuit.

Exemplary embodiments relate to a gate driving circuit with improved reliability and a display device including the gate driving circuit.

In an exemplary embodiment, a gate driving circuit includes a plurality of stages which outputs gate signals to corresponding gate lines, respectively. In such an embodiment, a stage of the plurality of stages includes: a first control transistor diode-connected between a first input end of the stage and a first node, where the first control transistor is biased by a first input signal of the first input end of the stage, and back-biased by a second input signal of a second input end of the stage; a second control transistor including a control end connected to a third input end of the stage and which receives a third input signal, a first end connected to the first node, and a second end connected to a first voltage, where the second control transistor is back-biased by a fourth input signal of a fourth input end of the stage; a first output transistor including a control end connected to the first node, a first end connected to a clock input end of the stage, and a second end connected to a first output end of the stage; and a capacitor connected between the control end of the first output transistor and the second end of the first output transistor. In such an embodiment, the second input signal and the fourth input signal have enable levels during different periods from each other.

In an exemplary embodiment, the stage of the plurality of stages may further include: a second output transistor including a control end connected to the first node, a first end connected to the clock input end, and a second end connected to a second output end of the stage to output a carry signal; and a third output transistor including a control end connected to the first node, a first end connected to the clock input end, and a second end connected to a third output end of the stage to output a compensation signal, where the second output transistor may be back-biased by the compensation signal.

In an exemplary embodiment, the second input signal may be a compensation signal output from a previous stage of the stage, among the plurality of stages.

In an exemplary embodiment, the fourth input signal may be a compensation signal output from a next stage of the stage, among the plurality of stages.

In an exemplary embodiment, the stage of the plurality of stages may further include: an inverter which outputs a signal synchronized to a clock signal of the clock input end to a second node during a period other than a period during which the carry signal is output; and holding units which provide a back-bias voltage to the third output end in response to a signal output from the second node.

In an exemplary embodiment, the inverter may include at least two transistors connected to a first voltage having a lower voltage level than a low level of the gate signals.

In an exemplary embodiment, the at least two transistors may be back-biased by one of the back-bias voltage or the compensation signal.

In an exemplary embodiment, the inverter may include: a first inverter transistor connected to a first voltage having a lower voltage level than a low level of the gate signals; and a second inverter transistor connected to a second voltage having a same voltage level as the low level of the gate signals.

In an exemplary embodiment, the first inverter transistor may be back-biased by one of the back-bias voltage and the compensation signal.

In an exemplary embodiment, the stage of the plurality of stages may further include a first pull-down transistor including a control end connected to the third input end to receive the third input signal, a first end connected to the third output end, and a second end connected to the back-bias voltage.

In an exemplary embodiment, the holding units may include: a first holding transistor including a control end connected to the second node and connected through a third node between the back-bias voltage and the third output end; and a second holding transistor including a control end connected to the second node and connected through the third node between the back-bias voltage and the third output end, and the stage of the plurality of stages may further include a fourth output transistor including a control end connected to the first node, a first end connected to the clock input end, and a second end connected to the third node.

In an exemplary embodiment, each of the first control transistor and the second control transistor may include: a first control electrode; an activation portion overlapping the first control electrode; an input electrode overlapping the activation portion; an output electrode overlapping the activation portion; and a second control electrode overlapping the first control electrode and the activation portion, where the second control electrode may receive the second input signal and the fourth input signal which controls threshold voltages of the first control transistor and the second control transistor.

In an exemplary embodiment, the first input signal and the second input signal may have an enable level during a same period as each other, and the first input signal may be transmitted to the first node through the first control transistor, a threshold voltage of which is lowered by the second input signal.

In another exemplary embodiment, a gate driving circuit includes a plurality of stages which outputs gate signals to corresponding gate lines, respectively. In such an embodiment, a stage of the plurality of stages includes: a first control transistor including a first end connected to a first end of the stage, a first control end, a second control end, and a second end connected to a first node; a second control transistor including first and second control ends connected to a second input end of the stage to receive a second input signal, a first end connected to the first node, and a second end connected to a first voltage; a first output transistor including a control end connected to the first node, a first end connected to a clock input end of the stage, and a second end connected to a first output end of the stage; and a capacitor connected between the control end of the first output transistor and the second end of the first output transistor.

In an exemplary embodiment, the stage of the plurality of stages may further include a second output transistor including a first control end connected to the first node, a first end connected to the clock input end, a second end connected to a second output end of the stage to output a carry signal, and a second control end connected to the second output end.

In an exemplary embodiment, the stage of the plurality of stages may further include an inverter which outputs a signal synchronized to a clock signal of the clock input end to a second node during a period other than a period during which the carry signal is output, wherein the inverter may include at least two transistors connected to a first voltage having a lower voltage level than a low level of the gate signal and back-biased by a back-bias voltage.

In an exemplary embodiment, the stage of the plurality of stages may further include an inverter which outputs a signal synchronized to a clock signal of the clock input end to a second node during a period other than a period during which the carry signal is output, where the inverter may include a first inverter transistor connected to a first voltage having a lower voltage level than a low level of the gate signal and back-biased by a back-bias voltage, and a second inverter transistor connected to a second voltage having a same voltage level as the low level.

In another exemplary embodiment, a display device includes: a display portion including a plurality of pixels connected to corresponding gate lines; and a gate driver including a plurality of stages which outputs gate signals to the corresponding gate lines. In such an embodiment, a stage of the plurality of stages includes: a first control transistor diode-connected between a first input end of the stage and a first node, where the first control transistor is biased by a first input signal of the first input end of the stage, and back-biased by a second input signal of a second input end of the stage; a second control transistor including a control end connected to a third input end to receive a third input signal, a first end connected to the first node, and a second end connected to a first voltage, where the second control transistor is back-biased by a fourth input signal of a fourth input end of the stage; a first output transistor including a control end connected to the first node, a first end connected to a clock input end of the stage, and a second end connected to a first output end of the stage; and a capacitor connected between the control end and the second end of the first output transistor, and the second input signal and the fourth input signal have an enable level during different periods from each other.

In an exemplary embodiment, the stage of the plurality of stages may further include: a second output transistor including a control end connected to the first node, a first end connected to the clock input end, and a second end connected to a second output end of the stage to output a carry signal; and a third output transistor including a control end connected to the first node, a first end connected to the clock input end, and a second end connected to a third output end of the stage to output a compensation signal, and the second output transistor may be back-biased by the compensation signal.

In an exemplary embodiment, the stage of the plurality of stages may further include an inverter which outputs a signal synchronized to a clock signal of the clock input end during a period other than a period during which the carry signal is output, and a holding unit which outputs a back-bias voltage to a third output end in response to a signal output from the second node.

In another exemplary embodiment, a gate driving circuit includes a plurality of stages which outputs gate signals to corresponding gate lines. In such an embodiment, a stage of the plurality of stages includes: a first control transistor diode-connected between a first input end of the stage and a first node, where the first control transistor is biased by a first input signal of the first input end of the stage, and back-biased by a second input signal of a second input end of the stage; a second control transistor including a control end connected to a third input end of the stage to receive a third input signal, a first end connected to the first node, and a second end connected to a first voltage, where the second control transistor is back-biased by a fourth input signal of a fourth input end of the stage; a first output transistor including a control end connected to the first node, a first end connected to a clock input end of the stage, and a second end connected to a first output end of the stage; a capacitor connected between a control end and a second end of the first output transistor; a second output transistor including a control end connected to the first node, a first end connected to the clock input end, and a second end connected to a second output end of the stage to output a carry signal; a first inverter transistor connected to a first voltage having a lower voltage level than a low level of the gate signal, where the first inverter transistor transmits the first voltage to the second node during a period during which the carry signal is output; and a second inverter transistor connected to a second voltage having a same voltage level as the low level of the gate signals, where the second inverter transistor is turned off during a period other than the period during which the carry signal is output. In such an embodiment, the second input signal and the fourth input signal have an enable level during different periods from each other.

According to exemplary embodiments, a gate driving circuit may have high reliability.

According to exemplary embodiments, a display device may have improved image display quality.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
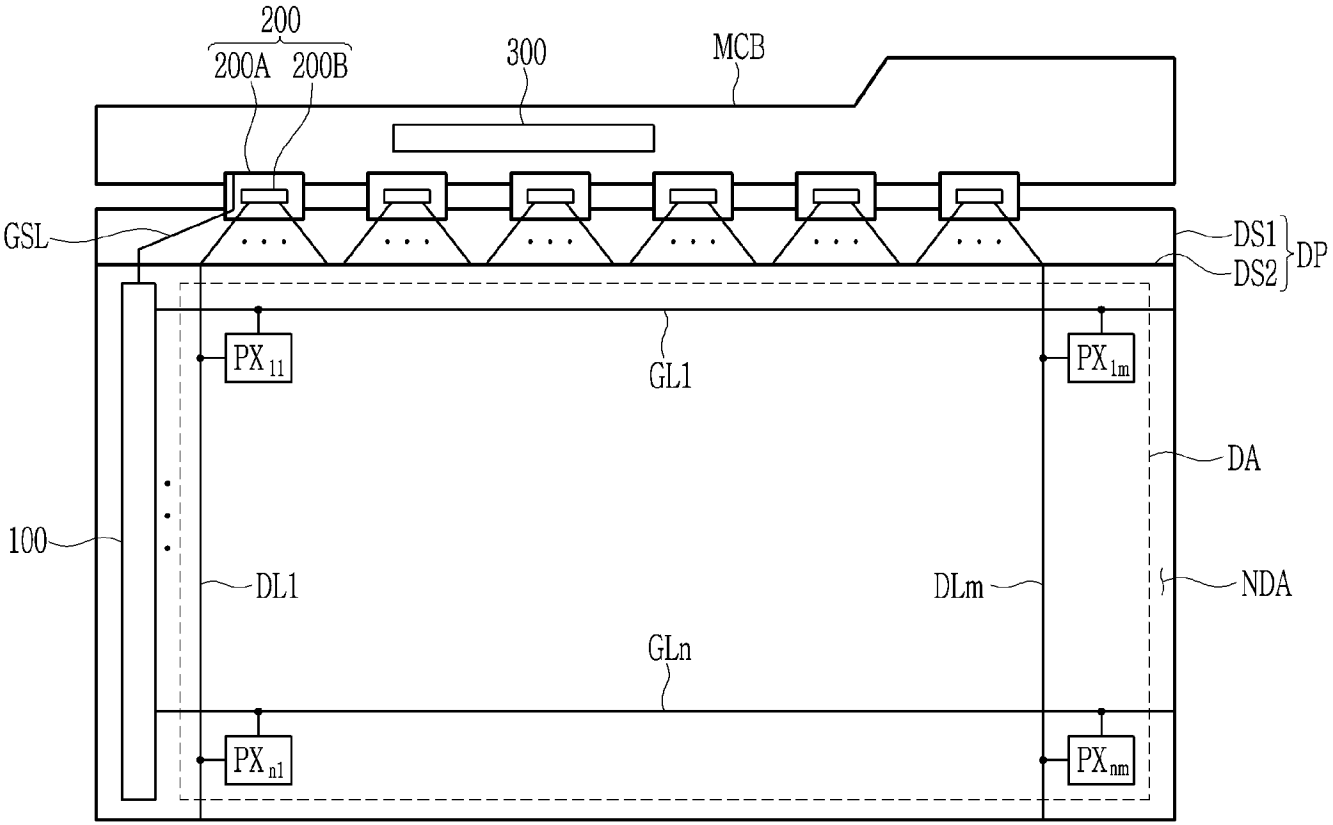
FIG. 1 is a top plan view of a display device according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a top plan view of a display device according to an exemplary embodiment. As shown in FIG. 1, an exemplary embodiment of a display device includes a display panel DP, a gate driving circuit 100, a data driving circuit 200, and a signal controller 300.

The display panel DP is not limited to a particular type, and may be one of various display panels, for example, a liquid crystal display panel, an organic light emitting diode display panel, an electrophoretic display panel, an electrowetting display panel, and the like. Hereinafter, for convenience of description, an exemplary embodiment where the display panel DP is a liquid crystal display panel will be described in detail. In such an embodiment, the display device is a liquid crystal display including the liquid crystal display panel, and the display device may further include a polarizer (not illustrated), a backlight unit, and the like.

The display panel DP includes a first substrate DS1, a second substrate DS2 that is disposed apart from the first substrate DS1, and a liquid crystal layer (referred to as LCL of FIG. 3) that is disposed between the first substrate DS1 and the second substrate DS2. In such an embodiment, the display panel DP includes a display area DA where a plurality of pixels PX11 to PXnm are disposed, and a non-display area NDA that surrounds the display area DA, when viewed from the top plane view as shown in FIG. 1.

The display panel DP includes a plurality of gate lines GL1 to GLn and a plurality of data lines DL1 to DLm that crosses the gate lines GL1 to GLn. The plurality of gate lines GL1 to GLn is connected to the gate driving circuit 100. The plurality of data lines DL1 to DLm is connected to the data driving circuit 200. In FIG. 1, for convenience of illustration, only some (GL1 and GLn) of the plurality of gate lines GL1 to GLn and only some (DL1 and DLm) of the plurality of data lines DL1 to DLm are illustrated.

Also, in FIG. 1, for convenience of illustration, only some (PX11, PX1*m*, PXn1, and PXnm) of the plurality of pixels PX11 to PXnm are illustrated. Each of the plurality of pixels PX11 to PXnm is connected to a corresponding gate line among the plurality of gate lines GL1 to GLn and a corresponding data line among the plurality of data lines DL1 to DLm.

The plurality of pixels PX11 to PXnm may be divided into a plurality of groups depending on a display color thereof. Each of the plurality of pixels PX11 to PXnm may display one of primary colors. The primary colors may include red, green and blue. However, exemplary embodiments are not limited thereto. Alternatively, the primary colors may further include various colors such as yellow, cyan, magenta, white, and the like.

The gate driving circuit 100 and the data driving circuit 200 receive controls signals from the signal controller 300. The signal controller 300 may be disposed on or installed in a main circuit board MCB. The signal controller 300 receives image data and control signals from an external graphics controller (not shown). The control signals may include a vertical synchronization signal that determines frame sections, a horizontal synchronization signal that is a row distinction signal in one frame, a data enable signal that has a high level only for a section during which data is output, and clock signals.

The gate driving circuit 100 generates gate signals based on a control signal (hereinafter referred to as a gate control signal) received through a signal line GSL from the signal controller 300, and outputs the gate signals to the plurality of gate lines GL1 to GLn. In an exemplary embodiment, the gate driving circuit 100 may be provided or formed with the pixels PX11 to PXnm through a same thin film process. In one exemplary embodiment, for example, the gate driving circuit 100 may be disposed in the non-display area NDA in the form of an amorphous silicon thin film transistor ("TFT") gate driver circuit ("ASG") or in the form of an oxide semiconductor TFT gate driver circuit ("OSG").

FIG. 1 shows an exemplary embodiment including a single gate driving circuit 100 connected to left ends of the plurality of gate lines GL1 to GLn. In an alternative exemplary embodiment, the display device may include two gate driving circuits. In such an embodiment, one of the two gate driving circuits may be connected to the left ends of the plurality of gate lines GL1 to GLn, and the other of the two gate driving circuits may be connected to the right ends of the plurality of gate lines GL1 to GLn. In such an embodiment, one of the two gate driving circuits may be connected to odd-numbered gate lines, and the other of the two gate driving circuits may be connected to even-numbered gate lines.

The data driving circuit 200 generates gray voltages corresponding to the image data supplied from the signal controller 300 based on a control signal (hereinafter, will be referred to as a data control signal) received from the signal controller 300. The data driving circuit 200 outputs the gray voltages to the plurality of data lines DL1 to DLm as data voltages.

The data voltages may include positive data voltages having positive values with respect to a common voltage and/or negative data voltages having negative values with respect to the common voltage. Some of data voltages applied to the data lines DL1 to DLm during the respective periods may be positive, and others of the data voltages applied to the data lines DL1 to DLm during the respective periods may be negative. Polarity of the data voltages may be inverted on a frame-by-frame basis or a line-by-line basis to prevent deterioration of liquid crystals. The data driving circuit 200 may generate inverted data voltages in frame section units in response to an inversion signal.

The data driving circuit 200 may include a driving chip 200A and a flexible circuit board 200B where the driving chip 200A is installed. In an exemplary embodiment, as shown in FIG. 1, the data driving circuit 200 may include a plurality of driving chips 200A and a plurality of flexible circuit boards 200B. The flexible circuit board 200B electrically connects a main circuit board MCB and the first substrate DS1. Each of the plurality of driving chips 200A may provide corresponding data signals to corresponding data lines among the plurality of data lines DL1 to DLm.

In an exemplary embodiment, as shown in FIG. 1, the data driving circuit 200 may be a tape carrier package ("TCP") type. In an alternative exemplary embodiment of the invention, the data driving circuit 200 may be disposed on the non-display area NDA of the first substrate DS1 by a chip-on-glass ("COG") method.

Figure 2:
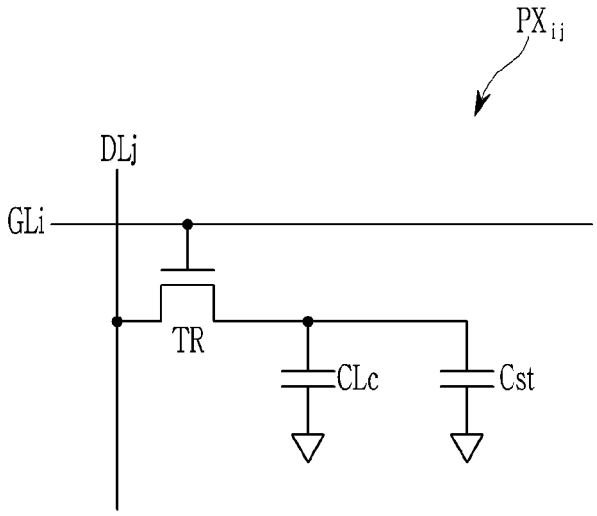
FIG. 2 is an equivalent circuit diagram of an exemplary embodiment of a pixel of FIG. 1.
Figure 3:
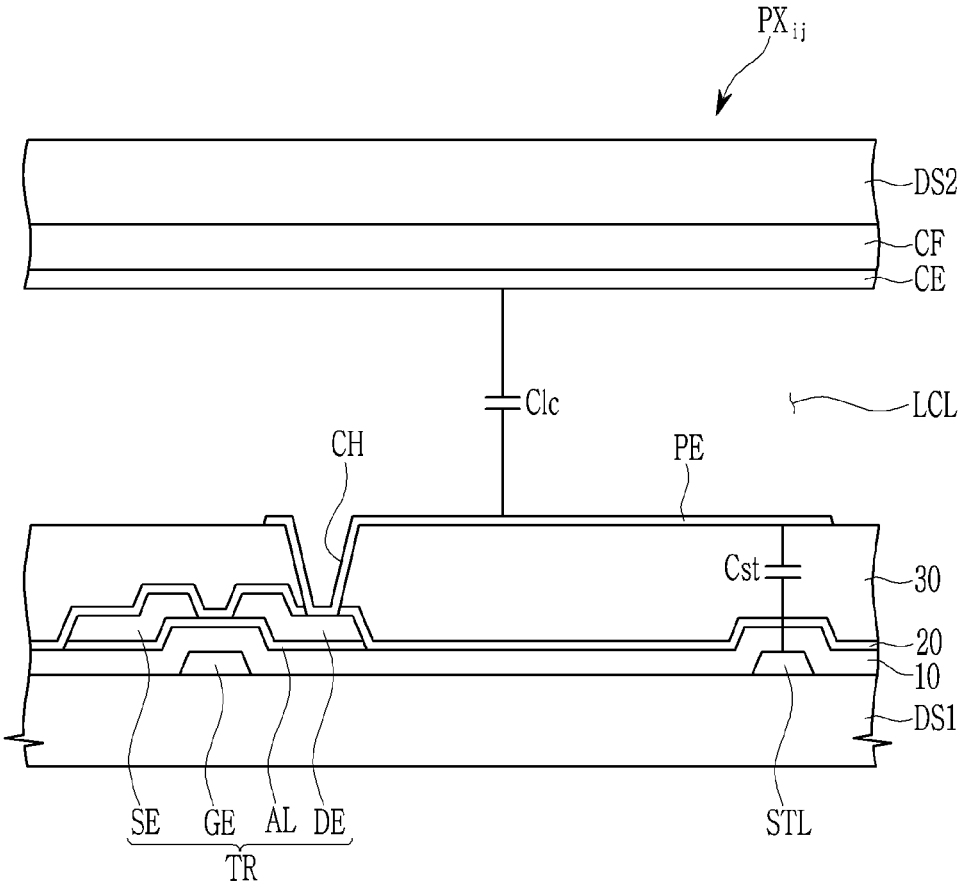
FIG. 3 is a cross-sectional view of an exemplary embodiment of a pixel of FIG. 1.

FIG. 2 is an equivalent circuit diagram of an exemplary embodiment of a pixel of FIG. 1, and FIG. 3 is a cross-sectional view of an exemplary embodiment of a pixel of FIG. 1. Each of the plurality of pixels PX11 to PXnm shown in FIG. 1 may have a structure corresponding to the equivalent circuit shown in FIG. 2.

In an exemplary embodiment, as shown in FIG. 2, a pixel PXij includes a pixel thin film transistor TR (hereinafter referred to as a pixel transistor), a liquid crystal capacitor Clc, and a storage capacitor Cst. Hereinafter, for convenience of description, exemplary embodiments where the transistor is a thin film transistor will be described. In an alternative exemplary embodiment, the storage capacitor Cst may be omitted.

In such an embodiment, the pixel transistor TR is electrically connected to an i-th gate line GLi and a j-th data line DLj. The pixel transistor TR outputs a pixel voltage corresponding to a data signal received from the j-th data line DLj in response to a gate signal received from the i-th gate line GLi.

The liquid crystal capacitor Clc charges a pixel voltage output from the pixel transistor TR. Depending on an amount of charges charged in the liquid crystal capacitor Clc, an alignment of liquid crystal directors included in the liquid crystal layer LCL (refer to FIG. 3) is changed. Light incident on the liquid crystal layer is transmitted or blocked depending on the alignment of the liquid crystal directors.

The storage capacitor Cst is connected in parallel to the liquid crystal capacitor Clc. The storage capacitor Cst maintains the alignment of the liquid crystal directors for a constant section.

In an exemplary embodiment, as shown in FIG. 3, the pixel transistor TR includes a control end GE connected to the i-th gate line GLi (refer to FIG. 2), an activation portion AL overlapping the control end GE, an input terminal SE (e.g., a source electrode) connected to the j-th data line DLj (refer to FIG. 2), and an output terminal DE (e.g., a drain electrode) disposed spaced apart from the input terminal SE.

The liquid crystal capacitor Clc includes a pixel electrode PE and a common electrode CE. The storage capacitor Cst includes the pixel electrode PE and a part of a storage line STL that overlaps the pixel electrode PE, as two terminals thereof.

The i-th gate line GLi and the storage line STL are disposed on a surface (e.g., an upper surface) of the first substrate DS1. The control end GE is branched from the i-th gate line GLi. The i-th gate line GLi and the storage line STL may include a metal such as aluminum (Al), silver (Ag), copper (Cu), molybdenum (Mo), chromium (Cr), tantalum (Ta), titanium (Ti), and the like, or an alloy thereof. The i-th gate line GLi and the storage line STL may have a multi-layered structure, and for example, may include a titanium layer and a copper layer.

A first insulation layer 10 is disposed on the surface of the first substrate DS1 to cover the control end GE and the storage line STL on the first substrate DS1. The first insulation layer 10 may include at least one of an inorganic material and an organic material. The first insulation layer 10 may be an organic layer or an inorganic layer. The first insulation layer 10 may have a multi-layered structure, and for example, may include a silicon nitride layer and a silicon oxide layer.

The activation portion AL that overlaps the control end GE is disposed on the first insulation layer 10. The activation portion AL may include a semiconductor layer and an ohmic contact layer. The semiconductor layer is disposed on the first insulation layer 10, and the ohmic contact layer is disposed on the semiconductor layer.

The output terminal DE and the input terminal SE are disposed on the activation portion AL. The output terminal DE and the input terminal SE are disposed spaced apart from each other. The output terminal DE and the input terminal SE respectively partially overlap the control end GE.

A second insulation layer 20 is disposed on the first insulation layer 10 to cover the activation portion AL, the output terminal DE and the input terminal SE on the first insulation layer 10. The second insulation layer 20 may include at least one of an inorganic material and an organic material. The second insulation layer 20 may be an organic layer or an inorganic layer. The second insulation layer 20 may have a multi-layered structure, and for example, may include a silicon nitride layer and a silicon oxide layer.

In an exemplary embodiment as shown in FIG. 3, the pixel transistor TR may have a staggered structure, but the structure of the pixel transistor TR is not limited thereto. In an alternative exemplary embodiment, the pixel transistor TR may have a planar structure.

A third insulation layer 30 is disposed on the second insulation layer 20. The third insulation layer 30 provides a flat surface to compensate a step or level differences due to elements or layer therebelow. The third insulation layer 30 may include an organic material.

The pixel electrode PE is disposed on the third insulation layer 30. The pixel electrode PE is connected to the output terminal DE through a contact hole CH defined through the second insulation layer 20 and the third insulation layer 30. An alignment layer (not shown) that covers the pixel electrode PE may be disposed on the third insulation layer 30.

A color filter layer CF is disposed on a surface (e.g., a lower surface) of the second substrate DS2. The common electrode CE is disposed on the color filter layer CF. A common voltage may be applied to the common electrode CE. The common voltage and the pixel voltage have different values. An alignment layer (not shown) that covers the common electrode CE may be disposed on the common electrode CE. Another insulation layer may be disposed between the color filter layer CF and the common electrode CE.

In an exemplary embodiment, the pixel electrode PE and the common electrode CE collectively define the liquid crystal capacitor Clc, with the liquid crystal layer LCL interposed therebetween. In such an embodiment, the pixel electrode PE and a part of the storage line STL collectively define the storage capacitor Cst with the first insulation layer 10, the second insulation layer 20 and the third insulation layer 30 interposed therebetween. The storage line STL receives a storage voltage that is different from the pixel voltage. The storage voltage may have a same value (e.g., a same voltage level) as the common voltage.

FIG. 3 shows a cross-section of an exemplary embodiment of the pixel PXij of FIG. 2 connected to the i-th gate line and the j-th data line. In an alternative exemplary embodiment, at least one of the color filter layer CF and the common electrode CE may be disposed on the first substrate DS1. In such an embodiment, the liquid crystal display panel may include pixels of a vertical alignment ("VA") mode, a patterned vertical alignment ("PVA") mode, an in-plane switching ("IPS") mode, a fringe-field switching ("FFS") mode, a plane-to-line switching ("PLS") mode, or the like.

Next, an exemplary embodiment of the gate driving circuit of the display device will be described with reference to FIG. 4.

Figure 4:
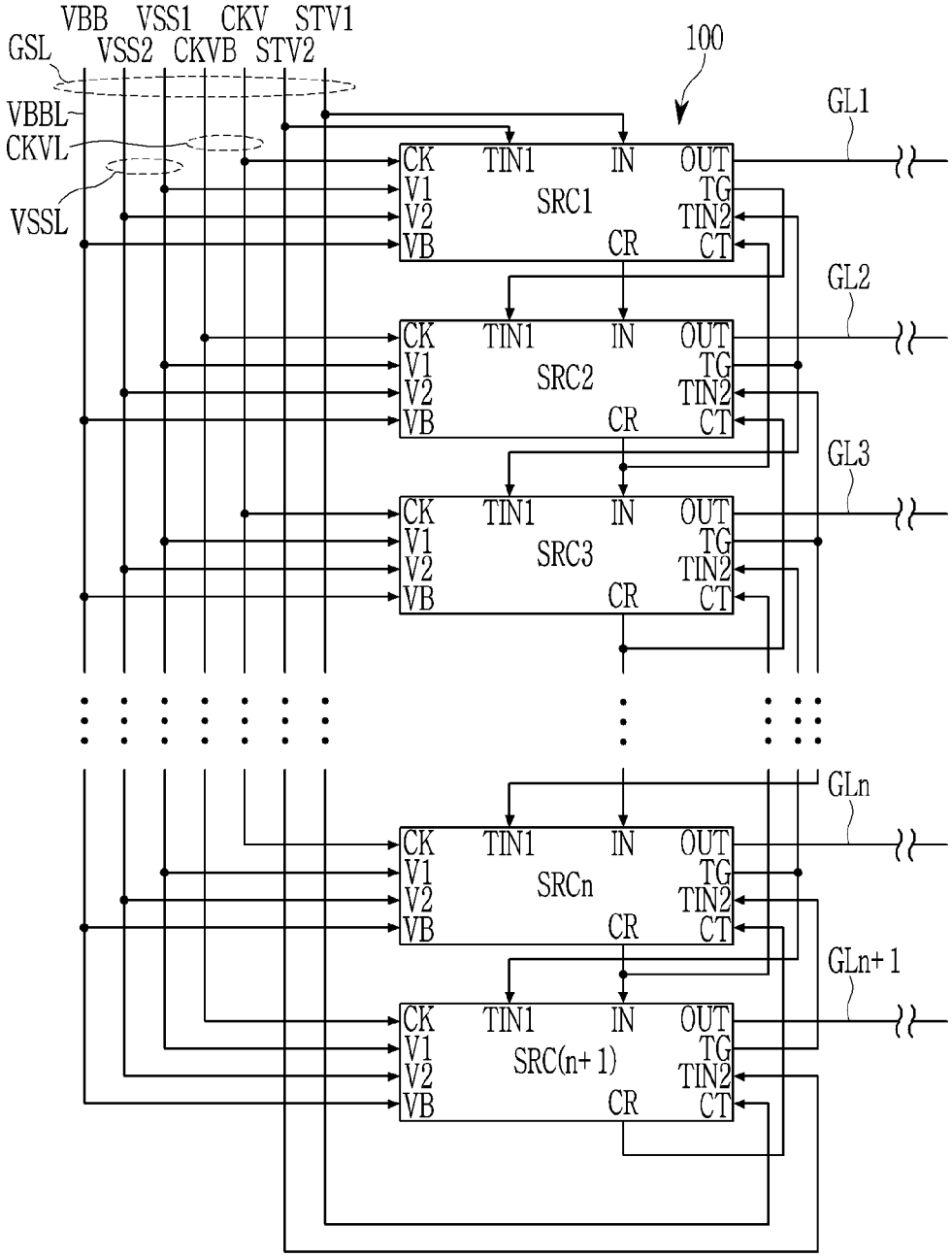
FIG. 4 is a block diagram of a gate driving circuit according to an exemplary embodiment.

FIG. 4 is a block diagram of the gate driving circuit according to an exemplary embodiment.

In an exemplary embodiment, as shown in FIG. 4, the gate driving circuit 100 includes a plurality of driving stages, e.g., first to n-th stages SRC1 to SRCn, and a dummy driving stage SRC(n+1). The plurality of driving stages SRC1 to SRCn and the dummy driving stage SRC(n+1) have a dependent connection relationship (e.g., a cascade connection) in which each driving stage operates in response to a carry signal output from a previous stage thereof and a carrier signal output from a next stage thereof.

Each of the plurality of driving stages SRC1 to SRCn receives a first or second clock signal CKV or CKVB, a first ground voltage VSS1, a second ground voltage VSS2, and a back bias voltage VBB from the signal controller 300 shown in FIG. 1 through the signal line GSL. The first driving stage SRC1 and the dummy driving stage SRC(n+1) further receive a start signal STV1 and a compensation start signal STV2.

The signal line GSL includes a back bias voltage signal line VBBL for transmitting the back bias voltage VBB, clock signal lines CKVL for transmitting the first clock signal CKV and the second clock signal CKVB, and ground voltage lines VSSL for transmitting the first ground voltage VSS1 and the second ground voltage VSS2.

In exemplary embodiments, the plurality of driving stages SRC1 to SRCn are respectively connected to the plurality of gate lines GL1 to GLn. The plurality of driving stages SRC1 to SRCn respectively provide gate signals to the plurality of gate lines GL1 to GLn. In an exemplary embodiment, gate lines connected to the plurality of driving stages SRC1 to SRCn may be divided into odd-numbered gate lines or even-numbered gate lines.

In an exemplary embodiment, as shown in FIG. 4, each of The plurality of driving stages SRC1 to SRCn and the dummy driving stage SRC(n+1) includes an output terminal OUT, a carry terminal CR, a compensation terminal TG, an input terminal IN, a control terminal CT, a clock terminal CK, compensation input terminals TIN1 and TIN2, a first ground terminal V1, a second ground terminal V2, and a bias voltage terminal VB.

The output terminal OUT of each of the plurality of driving stages SRC1 to SRCn is connected to a corresponding gate line among the plurality of gate lines GL1 to GLn. The output terminal OUT of the dummy driving stage SRC(n+1) is connected to a dummy gate line GLn+1. Gate signals generated from the plurality of driving stages SRC1 to SRCn are provided to the plurality of gate lines GL1 to GLn through the output terminals OUT thereof, respectively.

The carry terminal CR of each of the plurality of driving stages SRC1 to SRCn is electrically connected to the input terminal IN of a next driving stage thereof. The carry terminals CR of the plurality of driving stages SRC1 to SRCn output carry signals, respectively.

The compensation terminal TG of each of the plurality of driving stages SRC2 to SRCn is connected to the compensation input terminal TIN1 of the next driving stage thereof and the compensation input terminal TIN2 of a previous driving stage thereof. The compensation terminals TG of the plurality of driving stages SRC1 to SRCn output compensation signals. The compensation terminal TG of the first driving stage SRC1 is electrically connected to a compensation input terminal TIN1 of the second driving stage SRC2.

An input terminal IN of each of the second to n-th driving stages SRC2 to SRCn and the dummy driving stage SRC (n+1) receives a carry signal of a previous driving stage thereof. In one exemplary embodiment, for example, an input terminal IN of the third driving stage SRC3 receives a carry signal of the second driving stage SRC2. The input terminal IN of the first driving stage SRC1 receives a start signal STV1 that starts driving of the gate driving circuit 100 instead as there is no previous driving stage thereof.

A control terminal CT of each of the plurality of driving stages SRC1 to SRCn is electrically connected to a carry terminal CR of the next driving stage thereof, and receives a carry signal of the next driving stage thereof. In one exemplary embodiment, for example, a control terminal CT of the second driving stage SRC2 receives a carry signal of the carry terminal CR of the third driving stage SRC3. In an alternative exemplary embodiment, the control terminal CT of each of the plurality of driving stages SRC1 to SRCn may be electrically connected to the output terminal OUT of the next driving stage thereof.

The control terminal CT of the last driving stage that is disposed at the end, or the n-th driving stage SRCn, receives a carry signal output from the carry terminal CR of the dummy driving stage SRC(n+1). The control terminal CT of the dummy driving stage SRC(n+1) receives the start signal STV1.

A clock terminal CK of each of the plurality of driving stages SRC1 to SRCn and the dummy driving stage SRC (n+1) receives one of a first clock signal CKV and a second clock signal CKVB. Clock terminals CK of odd-numbered driving stages SRC1, SRC3 . . . , SRC(n−1) of the plurality of driving stages SRC1 to SRCn may receive the first clock signal CKV. Clock terminals CK of even-numbered driving stages SRC2 . . . , SRCn of the plurality of driving stages SRC1 to SRCn may receive the second clock signal CKVB. The first clock signal CKV and the second clock signal CKVB may have different phases from each other.

A compensation input terminal TIN1 of each of the plurality of driving stages SRC2 to SRCn and the dummy driving stage SRC(n+1) is electrically connected to a compensation terminal TG of the previous driving stage thereof. The compensation input terminal TIN1 of the first driving stage SRC1 receives a compensation start signal STV2 instead.

The compensation input terminal TIN2 of each of the plurality of driving stages SRC1 to SRCn is electrically connected to the compensation terminal TG of the next driving stage thereof.

The compensation input terminal TIN2 of the n-th driving stage SRCn disposed at the end receives a compensation signal output from a compensation terminal TG of the dummy driving stage SRC(n+1). The compensation input terminal TIN2 of the dummy driving stage SRC(n+1) receives the compensate start signal STV2.

The first ground terminal V1 of each of the plurality of driving stages SRC1 to SRCn and the dummy driving stage SRC(n+1) receives a first ground voltage VSS1. The second ground terminal V2 of each of the plurality of driving stages SRC1 to SRCn and the dummy driving stage SRC(n+1) receives a second ground voltage VSS2. The first ground voltage VSS1 and the second ground voltage VSS2 have different voltage levels from each other, and the second ground voltage VSS2 is lower than the first ground voltage VSS1.

The bias voltage terminal VB of each of the plurality of driving stages SRC1 to SRCn and the dummy driving stage SRC(n+1) receives a back bias voltage VBB. The back bias voltage VBB has a voltage level that is lower than the first ground voltage VSS1 and the second ground voltage VSS2.

Next, a driving stage will be described in greater detail with reference to FIG. 5.

Figure 5:
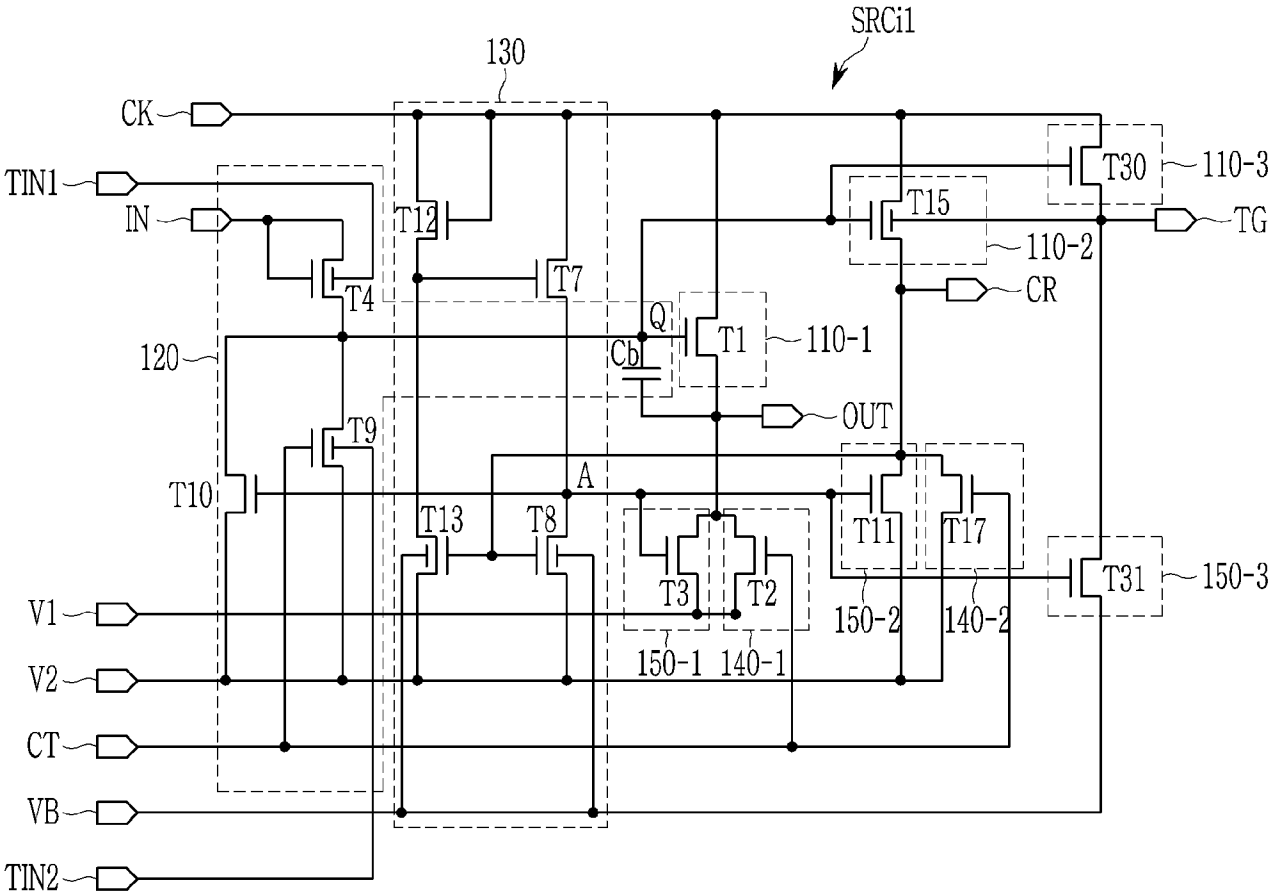
FIG. 5 is a circuit diagram of an exemplary embodiment of a driving stage of FIG. 4.

FIG. 5 is a circuit diagram of an exemplary embodiment of a driving stage of FIG. 4.

FIG. 5 illustrates an exemplary embodiment of an i-th driving stage SRCi1 (here, i is a positive integer) among the plurality of driving stages SRC1 to SRCn shown in FIG. 4. Each of the plurality of driving stages SRC1 to SRCn shown in FIG. 4 may have the same circuit structure as that of the i-th driving stage SRCi1.

Referring to FIG. 5, an exemplary embodiment of the i-th driving stage SRCi1 includes output units 110-1, 110-2 and 110-3, a controller 120, an inverter 130, pull-down units 140-1 and 140-2, and holding units 150-1, 150-2 and 150-3.

The output unit 110-1 outputs an i-th gate signal, the output unit 110-2 outputs an i-th carry signal, and the output unit 110-3 outputs an i-th compensation signal.

The pull-down unit 140-1 pulls down an output terminal OUT with a first ground voltage VSS1 that is connected to the first ground terminal V1. The pull-down unit 140-2 pulls down a carry terminal CR with a second ground voltage VSS2 that is connected to the second ground terminal V2.

The holding unit 150-1 holds the output terminal OUT in a pulled-down state. The holding unit 150-2 maintains the carry terminal CR in a pulled-down state. The holding unit 150-3 holes the compensation terminal TG at the back bias voltage VBB.

The controller 120 controls operations of the output units 110-1, 110-2 and 110-3, the pull-down units 140-1 and 140-2, and the holding units 150-1, 150-2 and 150-3.

Hereinafter, the configuration of the i-th driving stage SRCi1 will be described in greater detail.

In an exemplary embodiment, the output unit 110-1 includes a first output transistor T1. The first output transistor T1 includes an input end connected to the clock terminal CK, a control end connected to a first node Q, and an output end that outputs the i-th gate signal.

The output unit 110-2 includes a second output transistor T15. The second output transistor T15 includes an input end connected to the clock terminal CK, a first control end connected to the first node Q, a second control end connected to the compensation terminal TG, and an output end that outputs the i-th carry signal.

The output unit 110-3 includes a third output transistor T30. The third output transistor T30 includes an input end connected to the clock terminal CK, a control end connected to the first node Q, and an output end that outputs the i-th compensation signal.

As shown in FIG. 4, the clock terminals CK of some of the driving stages SRC1, SRC3, . . . , and SRCn−1 among the driving stages SRC1 to SRCn and the dummy driving stage SRC(n+1) receive the first clock signal CKV. The clock terminals CK of the remaining driving stages SRC2, SRC4, . . . , and SRCn among the driving stages SRC1 to SRCn receive the second clock signal CKVB. In an exemplary embodiment, the first clock signal CKV and the second clock signal CKVB are complimentary signals. In such an embodiment, the first clock signal CKV and the second clock signal CKVB may have a phase difference of about 180°.

The controller 120 turns on the first output transistor T1, the second output transistor T15, and the third output transistor T30 in response to an (i−1)-th carry signal received through the input terminal IN from the previous driving stage. The controller 120 turns off the first output transistor T1, the second output transistor T15, and the third output transistor T30 in response to an (i+1)-th carry signal received through the control terminal CT from the next driving stage. The controller 120 provides the second ground voltage VSS2 to the first node Q in response to a switching signal output from the inverter 130.

The controller 120 includes a first control transistor T4, a second control transistor T9, a third control transistor T10 and a capacitor Cb.

The first control transistor T4 is connected between the input terminal IN and the first node Q, and includes a first control end connected to the input terminal IN and a second control end connected to the compensation input terminal TIN1.

The second control transistor T9 is connected between the first node Q and the second ground terminal V2, and includes a first control end connected to the control terminal CT and a second control end connected to the compensation input terminal TIN2.

The third control transistor T10 is connected between the first node Q and the second ground terminal V2, and includes a control end connected to a second node A.

The capacitor Cb is connected between the output terminal OUT and a control end of the controller 120 (e.g., the first node Q).

The inverter 130 outputs a switching signal to the second node A. The inverter 130 includes first to fourth inverter transistors T12, T7, T13 and T8.

The first inverter transistor T12 includes an input end, a control end and an output end. The input end and the control end of the first inverter transistor T12 are commonly connected to the clock terminal CK, and the output end of the first inverter transistor T12 is connected to a control end of the second inverter transistor T7. The second inverter transistor T7 includes an input end connected to the clock terminal CK, an output end connected to the second node A, and the control end connected to the output end of the first inverter transistor T12.

The third inverter transistor T13 includes an output end connected to the output end of the first inverter transistor T12, a first control end connected to the carry terminal CR, a second control end connected to the bias voltage terminal VB, and an input end connected to the second ground terminal V2. The fourth inverter transistor T8 includes an output end connected to the second node A, a first control end connected to the carry terminal CR, a second control end connected to the bias voltage terminal VB, and an input end connected to the second ground terminal V2. In an alternative exemplary embodiment, first control ends of the third and fourth inverter transistors T13 and T8 may be connected to the output terminal OUT.

The pull-down unit 140-1 includes a first pull-down transistor T2. The first pull-down transistor T2 is connected between the output terminal OUT and the first ground terminal V1, and includes a control end connected to the control terminal CT.

The pull-down unit 140-2 includes a second pull-down transistor T17. The second pull-down transistor T17 is connected between the carry terminal CR and the second ground terminal V2, and includes a control end connected to the control terminal CT.

The holding unit 150-1 includes a first holding transistor T3. The first holding transistor T3 is connected between the output terminal OUT and the first ground terminal V1, and includes a control end connected to the second node A.

The holding unit 150-2 includes a second holding transistor T11. The second holding transistor T11 is connected between the carry terminal CR and the first ground terminal V1, and includes a control end connected to the second node A.

The holding unit 150-3 includes a third holding transistor T31. The third holding transistor T31 is connected between the compensation terminal TG and the bias voltage terminal VB, and includes a control end connected to the second node A.

Among the transistors in the driving stage SRCi1 shown in FIG. 5, the second output transistor T15, the first control transistor T4, the second control transistor T9, the third inverter transistor T13 and the fourth inverter transistor T8 are 4-terminal transistors (e.g., transistors having dual gate structure), threshold voltages of which may be adjusted.

In such an embodiment, the second output transistor T15, the first control transistor T4, the second control transistor T9, the third inverter transistor T13 and the fourth inverter transistor T8 respectively further include a second control end in addition to an input end, an output end, and a first control end.

The second control end of the second output transistor T15 is connected to the compensation terminal TG.

The second control end of the first control transistor T4 is connected to the compensation input terminal TIN1. The second control end of the second control transistor T9 is connected to the compensation input terminal TIN2.

In an exemplary embodiment, as shown in FIG. 5, the second output transistor T15, the first control transistor T4, the second control transistor T9, the third inverter transistor T13 and the fourth inverter transistor T8 are 4-terminal transistors, but not being limited thereto. In an alternative exemplary embodiment, at least one of the second output transistor T15, the first control transistor T4, the second control transistor T9 and the fourth inverter transistor T8 may be a 3-terminal transistor.

A structure of the first output transistor, which is the 4-terminal transistor, will now be described in detail with reference to FIG. 6.

Figure 6:
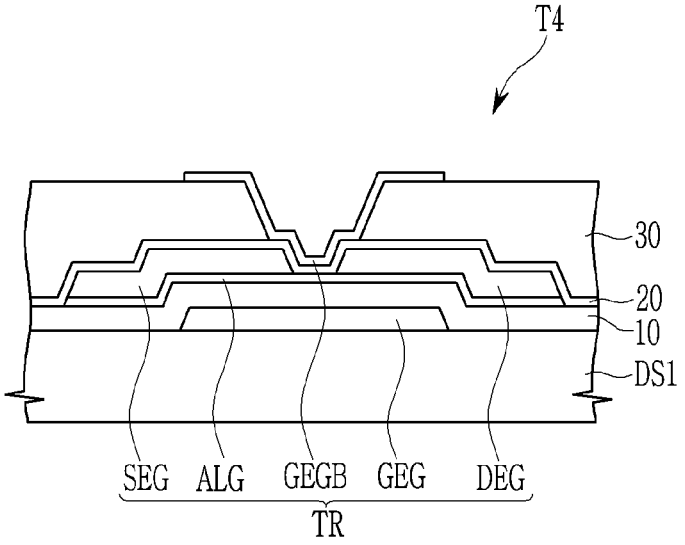
FIG. 6 is a cross-sectional view of an exemplary embodiment of a first control transistor shown in FIG. 5.

FIG. 6 is a cross-sectional view of an exemplary embodiment of the first control transistor T4 shown in FIG. 5. FIG. 6 illustrates only a cross-sectional view of the first control transistor T4, but the second output transistor T15, the second control transistor T9, the third inverter transistor T13, and the fourth inverter transistor T8 have a same configuration as the first control transistor T4.

Referring to FIG. 6, an exemplary embodiment of the first control transistor T4 includes a control electrode GEG connected to the first node Q, an activation portion ALG overlapping the control electrode GEG, an input electrode SEG connected to the clock terminal CK, and an output electrode disposed apart from the input electrode SEG.

The first control transistor T4 may be disposed on a same first substrate DS1 as the pixel transistor TR described in FIG. 3. A first insulation layer 10 that covers the control electrode GEG and a storage line STL is disposed on a surface (e.g., an upper surface) of the first substrate DS1. The first insulation layer 10 may include at least one of an inorganic material and an organic material. The first insulation layer 10 may be an organic layer or an inorganic layer. The first insulation layer 10 may have a multi-layer structure including, for example, a silicon nitride layer and a silicon oxide layer.

The activation portion ALG that overlaps the control electrode GEG is disposed on the first insulation layer 10. The activation portion ALG may include a semiconductor layer and an ohmic contact layer. The semiconductor layer is disposed on the first insulation layer 10, and the ohmic contact layer is disposed on the semiconductor layer.

The output electrode DEG and the input electrode SEG are disposed on the activation portion ALG. The output electrode DEG and the input electrode SEG are spaced apart from each other. Each of the output electrode DEG and the input electrode SEG partially overlap the control electrode GEG.

A second insulation layer 20 is disposed on the first insulation layer 10 to cover the activation portion ALG, the output electrode DEG and the input electrode SEG. The second insulation layer 20 may include at least one of an inorganic material and an organic material. The second insulation layer 20 may be an organic layer or an inorganic layer. The second insulation layer 20 may have a multi-layer structure including, for example, a silicon nitride layer and a silicon oxide layer.

A third insulation layer 30 is disposed on the second insulation layer 20. The third insulation layer 30 provides a flat surface. The third insulation layer 30 may include an organic material.

A back gate electrode GEGB is disposed on the third insulation layer 30. A threshold voltage of the second output transistor may be changed according to a compensation signal of a previous driving stage, provided to the back gate electrode GEGB.

Figure 7:
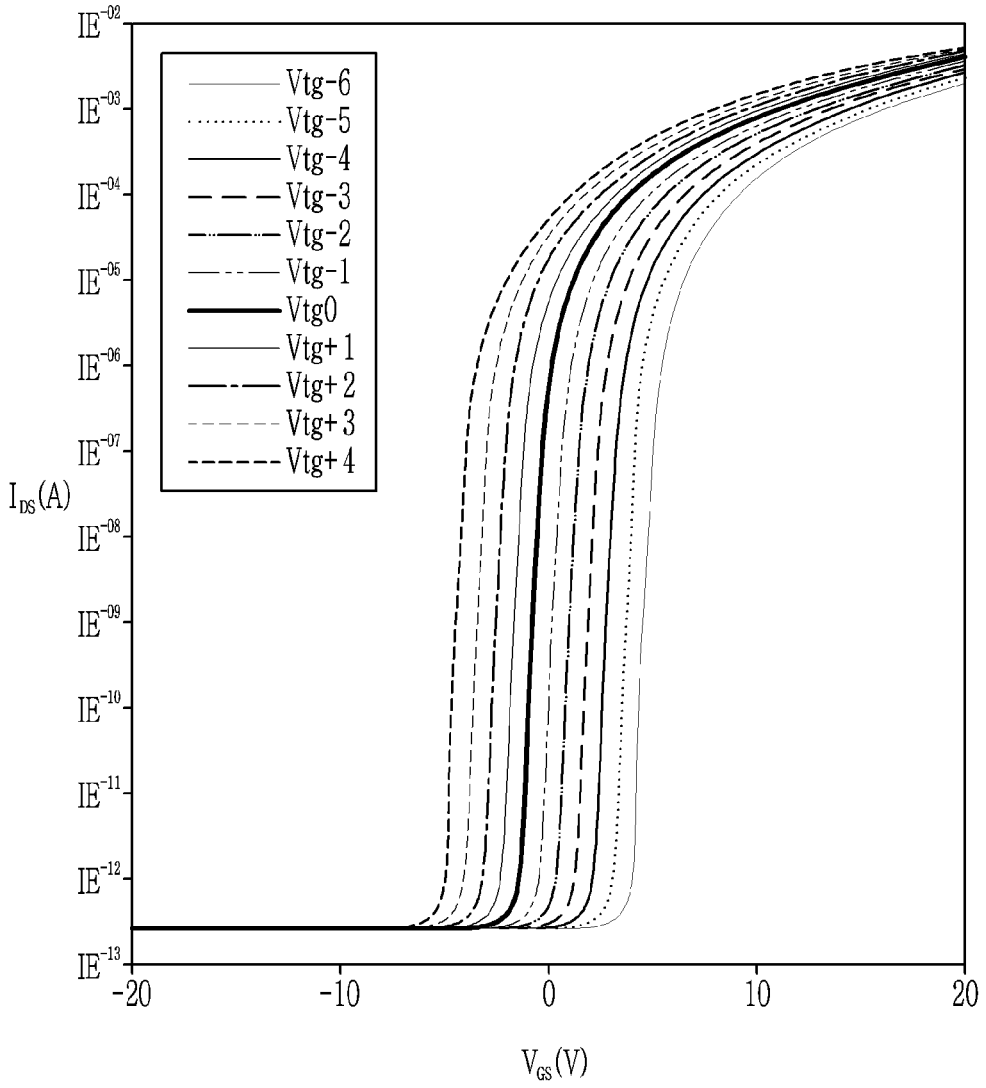
FIG. 7 shows a threshold voltage change according to a compensation signal voltage level supplied to a back gate electrode of the first control transistor shown in FIG. 6.

FIG. 7 shows a threshold voltage change according to a level of a compensation signal voltage provided to the back gate electrode of the first control transistor T4 shown in FIG. 6.

Referring to FIG. 7, the threshold voltage of the first control transistor T4 is positive-shifted as a voltage level of the compensation signal supplied to the back gate electrode of the first control transistor T4 becomes lower than a reference voltage Vtg0. As shown in FIG. 7, the threshold voltage of the first control transistor T4 is negative-shifted as the voltage level of the compensation signal supplied to the back gate electrode of the first control transistor T4 becomes higher than the reference voltage Vtg0.

When the gate driving circuit 100 installed as an OSG in the non-display area NDA of the display panel DP shown in FIG. 1 operates for a long period of time at a high temperature, the threshold voltages of the transistors shown in FIG. 5 are negative-shifted. Particularly, the threshold voltage change of the second output transistor T15, the first control transistor T4, the second control transistor T9, the third inverter transistor T13 and the fourth inverter transistor T8 substantially affects operation of the i-th driving stage SRCi1.

Specifically, when the threshold voltage of the second output transistor T15 is negative-shifted, the second output transistor T15 may be turned on at a lower gate-source voltage $V_{GS}$ such that a ripple may occur in the carry terminal CR.

When the threshold voltages of the first control transistor T4 and the second control transistor T9 are negative-shifted, the first control transistor T4 may be turned on at a much lower gate-source voltage $V_{GS}$, thereby causing a leakage current in the first node Q.

In addition, when the threshold voltages of the third inverter transistor T13 and the fourth inverter transistor T8 are negative-shifted, the third inverter transistor T13 and the fourth inverter transistor T8 may be turned on at a much lower gate-source voltage $V_{GS}$, thereby causing a leakage current through the third control transistor T10 and the second holding transistor T11.

Figure 8:
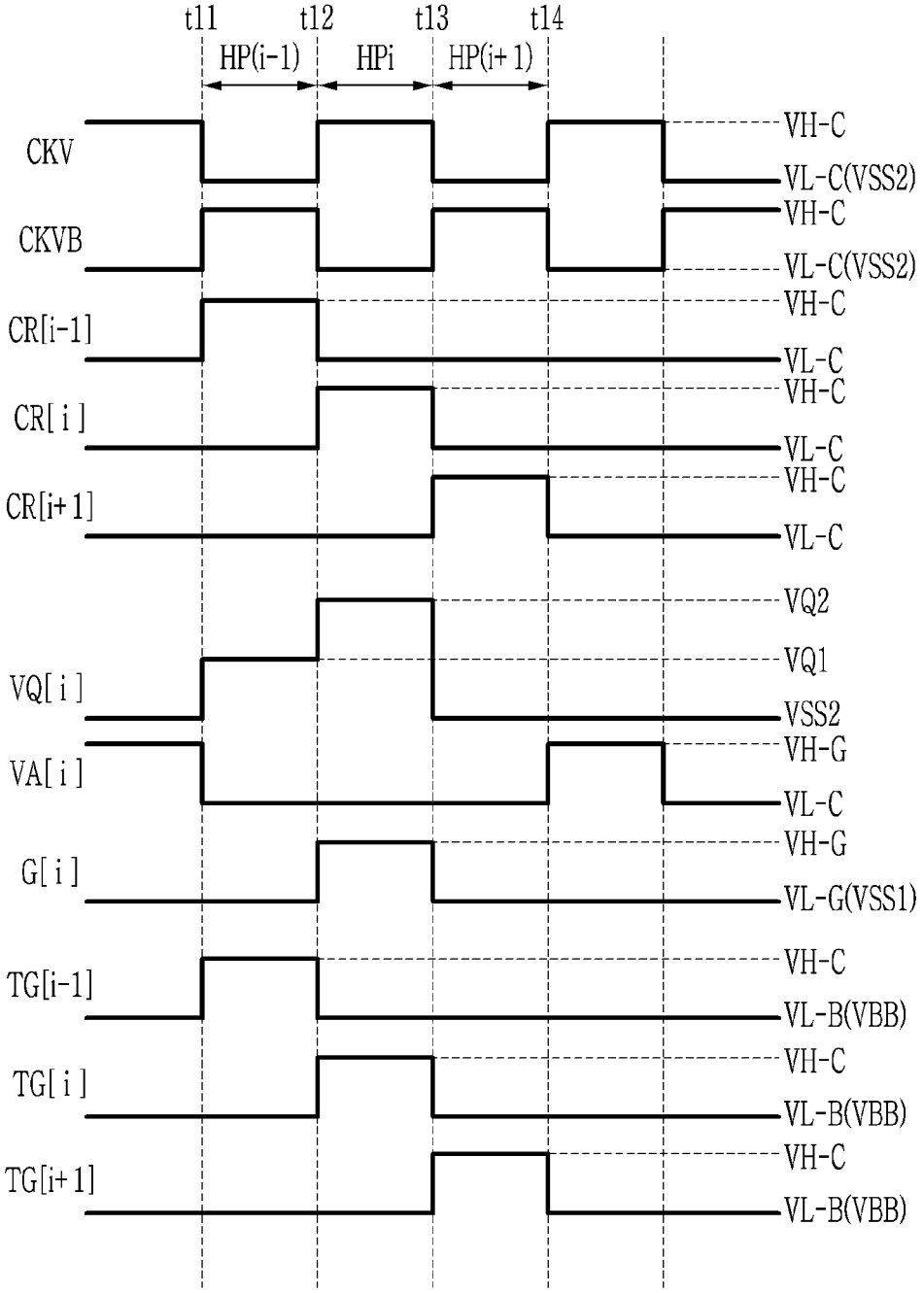
FIG. 8 is a timing diagram of signals of the display device according to an exemplary embodiment.

FIG. 8 is a timing diagram of signals of the display device according to an exemplary embodiment. As shown in FIG. 8, the first clock signal CKV and the second clock signal CKVB may be signals having phases inverted from each other. The first clock signal CKV and the second clock signal CKVB may have a phase difference of about 180°. Each of the first clock signal CKV and the second clock signal CKVB alternately has a low level having a low voltage level and a high level VH-C having a relatively high voltage level. A voltage level of the high level VH-C may be about 10 volts (V). A voltage level of the low level VL-C may be about −14 V. The low level VL-C may have a same voltage level as the second ground voltage VSS2.

One frame section includes a period during which a voltage level of an i-th gate signal G[i] is the low level VL-G and a period during which the voltage level of the i-th gate signal G[i] is the high level VH-G. The low level VL-G of the i-th gate signal G[i] may have the same voltage level as the first ground voltage VSS1. The low level VL-G may be about −12 V.

The i-th gate signal G[i] may have the same level as the low level VL-C of the first clock signal CKV or the second clock signal CKVB during some periods. A low level VL-C of the first clock signal CKV or the second clock signal CKVB is output by a pre-charged first node Q before the i-th gate signal G[i] reaches the high level VH-G.

The high level VH-G of the i-th gate signal G[i] may have the same level as the high level VH-C of the first clock signal CKV or the second clock signal CKVB.

The i-th carry signal CR[i] may have the low level VL-C having a low voltage level and the high level VH-C having a relatively high voltage level. Since the i-th carry signal CR[i] is generated based on the first clock signal CKV, the i-th carry signal CR[i] has a voltage level that is the same as or similar to the first clock signal CKV.

Referring back to FIG. 5, the controller 120 controls operations of the output units 110-1, 110-2 and 110-3. The controller 120 turns on the output units 110-1, 110-2 and 110-3 in response to an (i−1)-th carry signal CR[i−1] output from the previous stage thereof, i.e., an (i−1)-th driving stage. The controller 120 turns off the output units 110-1, 110-2 and 110-3 in response to an (i+1)-th carry signal CR[i+1] output from the next stage thereof, i.e., an (i+1)-th driving stage. In such an embodiment, the controller 120 maintains the turned off state of the output units 110-1, 110-2 and 110-3 according to the switching signal output from the inverter 130.

FIG. 8 shows a period HPi (hereinafter referred to as an i-th period) from a time point t12 to time point t13 during which an i-th gate signal G[i] is high level VH-G, a previous period HP(i−1) from a time point t11 to the time point t12 (referred to as an (i−1)-th period), and a next period HP(i+1) (referred to as an (i+1)-th period) from the time point t13 to a time point t14, among a plurality of periods.

The first control transistor T4 outputs a control signal, which controls a potential of the first node Q, to the first node Q. The second control transistor T9 provides the second ground voltage VSS2 to the first node Q in response to the (i+1)-th carry signal CR[i+1] output from the (i+1)-th stage. The third control transistor T10 provides the second ground voltage VSS2 to the first node Q in response to a switching signal output by the inverter 130.

As shown in FIGS. 6 and 8, a potential of the first node Q is increased to a first high level VQ1 by the (i−1)-th carry signal CR[i−1] during an (i−1)-th period HP(i−1). When a voltage of the first node Q (referred to as VQ[i] in FIG. 8) is increased to the first high level VQ1, a compensation signal TG[i−1] of the high level VH-C of the previous driving stage is applied to the second control end of the first control transistor T4 such that the threshold voltage may be lowered (e.g., negative-shifted). Accordingly, a current is increased by the (i−1)-th carry signal CR[i−1] flowing through the first control transistor T4.

In such an embodiment, the potential of the first node Q may be sufficiently increased to the first high level VQ1 by the (i−1)-th carry signal CR[i−1] applied to the input end and the first control end of the first control transistor T4. In such an embodiment, the (i−1)-th carry signal CR[i−1] is applied to the first node Q such that the capacitor Cb is charged with a voltage that corresponds to the (i−1)-th carry signal CR[i−1].

During the i-th period HPi, the i-th gate signal G[i] is output. When the i-th gate signal G[i] is output, the first node Q is boosted to a second high level VQ2 from the first high level VQ1.

During the i-th period HPi, the compensation signal TG[i−1] of the low level VL-B of the previous driving stage is applied to the second control end of the first control transistor T4. During the i-th period HPi, a compensation signal TG[i+1] of the low level VL-B of the next driving stage is applied to the second control end of the second control transistor T9.

In such an embodiment, the compensation signal TG[i−1] of the low level VL-B of the previous driving stage and the compensation signal TG[i+1] of the low level VL-B of the next driving stage have voltages that are similar or equal to the back bias voltage VBB. Therefore, the threshold voltages of the first and second control transistors T4 and T9 are increased (i.e., positive-shifted).

In such an embodiment, since the threshold voltages of the first and second control transistors T4 and T9 are increased, the first node Q is boosted to the second high level VQ2, and thus, even though a voltage difference at lateral ends of the first control transistor T4 is increased, a leakage current according to the increase of the voltage difference at lateral ends of the first control transistor T4 is reduced. In such an embodiment, although a voltage difference between lateral ends of the second control transistor T9 is increased, a leakage current according to the increase of the voltage difference between lateral ends of the second control transistor T9 is reduced. Accordingly, the potential of the first node Q is maintained at the second high level VQ2 so that the i-th gate signal G[i] may be output with a sufficiently high level.

During the i-th period HPi, the i-th carry signal CR[i] is output. When the i-th carry signal CR[i] is output, the compensation signal TG[i] of the high level VH-C is applied to the second control end of the second output transistor T15. Accordingly, the threshold voltage of the second output transistor T15 may be lowered (i.e., negative-shifted). Thus, the first clock signal CKV may be output with a sufficiently high level as the i-th carry signal CR[i] through the second output transistor T15.

In a period excluding the i-th period HPi, the compensation signal TG[i] of the low level VL-B is applied to the second control end of the second output transistor T15. Then, the threshold voltage of the second output transistor T15 is increased (i.e., positive-shifted). Thus, a leakage current of the second output transistor T15 is reduced so that a ripple at the carry terminal CR may be reduced.

During the (i+1)-th period HP(i+1), the second control transistor T9 provides the second ground voltage VSS2 to the first node Q in response to the (i+1)-th carry signal CR[i+1] output from the (i+1)-th stage. Then, the compensation signal TG[i+1] of the high level VH-C of the next driving stage is applied to the second control end of the second control transistor T9 so that the threshold voltage may be lowered (i.e., negative-shifted). Then, a current flowing through the second control transistor T9 is increased (refer to $I_{DS}$ of FIG. 7). Accordingly, during the (i+1)-th period HP(i+1), the voltage of the second high level VQ2 charged in the first node Q may be sufficiently discharged to the second ground voltage VSS2.

In such an embodiment, as shown in FIG. 8, the voltage of the first node Q is reduced to the second ground voltage VSS2 at the time point t13, at which the (i+1)-th period HP(i+1) starts. Accordingly, the first output transistor T1, the second output transistor T15 and the third output transistor T30 are turned off. Until the (i−1)-th gate signal G[i−1] of the next frame period is output after the (i+1)-th period HP(i+1), the voltage of the first node Q is maintained at the second ground voltage VSS2. Thus, until the (i−1)-th gate signal G[i−1] of the next frame period is output after the (i+1)-th period HP(i+1), the first output transistor T1, the second output transistor T15 and the third output transistor T30 are maintained in the turned-off state.

The voltage of the second node A (referred to as VA[i] in FIG. 8) has substantially the same phase as the first clock signal CKV, excluding the i-th period HPi. In a period excluding the i-th period HPi, a ripple generated from the carry terminal CR may be applied to the first control ends of the third and fourth inverter transistors T13 and T8. The second ground voltage VSS2 is applied to the input ends of the third and fourth inverter transistors T13 and T8 during the i-th period HPi. A leakage current may flow through the third and fourth inverter transistors T13 and T8 due to a potential difference between the first control ends and the input ends of the third and fourth inverter transistors T13 and T8.

In such an embodiment, the first clock signal CKV transmitted to the control end of the second inverter transistor T7 through the first inverter transistor T12 may be discharged through the third inverter transistor T13. Then, the voltage of the second node A has a phase that is different from that of the first clock signal CKV. Accordingly, the third control transistor T10, the second holding transistor T11 and the third holding transistor T31, control ends of which are connected to the second node A, may not effectively operate.

According to exemplary embodiments (refer to FIG. 5, FIG. 9, FIG. 12, and FIG. 13), the back bias voltage VBB is applied to the second control ends of the third and fourth inverter transistors T13 and T8 to increase the threshold voltages of the third and fourth inverter transistors T13 and T8. Thus, the leakage current of the third and fourth inverter transistors T13 and T8 due to the ripple generated at the carry terminal CR may be reduced.

According to alternative exemplary embodiments (refer to FIG. 11 and FIG. 17), the input end of the third inverter transistor T13 is connected to the first ground terminal V1. In such embodiments, a potential difference (i.e., gate-source voltage $V_{GS}$) between the input end and the control end of the third inverter transistor T13 is reduced to thereby reduce the leakage current of the third inverter transistor T13 caused by the ripple generated at the carry terminal CR.

In an exemplary embodiment, during the i-th period HPi, the third and fourth inverter transistors T13 and T8 are turned on in response to the i-th carry signal CR[i]. When the third and fourth inverter transistors T13 and T8 are turned on, the first clock signal CKV of the high level VH-C, output from the second inverter transistor T7, is synchronized with the second ground voltage VSS2 through the fourth inverter transistor T8, such that the second ground voltage VSS2 may be applied to the second node A.

In other periods, excluding the i-th period HPi, the first clock signal CKV of the high level VH-C output from the second inverter transistor T7 is provided to the second node A.

A voltage of the i-th gate signal G[i] after the (i+1)-th period HP(i+1) corresponds to a voltage of the output terminal OUT. During the (i+1)-th period HP(i+1), the first pull-down transistor T2 provides the first ground voltage VSS1 to the output terminal OUT in response to the (i+1)-th carry signal CR[i+1].

A voltage of the i-th carry signal CR[i] after the (i+1)-th period HP(i+1) corresponds to a voltage of the carry terminal CR. During the (i+1)-th period HP(i+1), the second pull-down transistor T17 provides the second ground voltage VSS2 to the carry terminal CR in response to the (i+1)-th carry signal CR[i+1].

After the (i+1)-th period HP(i+1), the first holding transistor T3 provides the first ground voltage VSS1 to the output terminal OUT in response to a switching signal output from the second node A.

After the (i+1)-th period HP(i+1), the second holding transistor T11 provides the second ground voltage VSS2 to the carry terminal CR in response to a switching signal output from the second node A.

After the (i+1)-th period HP(i+1), the third holding transistor T31 provides the back bias voltage VBB to the compensation terminal TG in response to a switching signal output from the second node A.

Next, alternative exemplary embodiments of the driving stage will be described with reference to FIG. 9 to FIG. 13.

Figure 9:
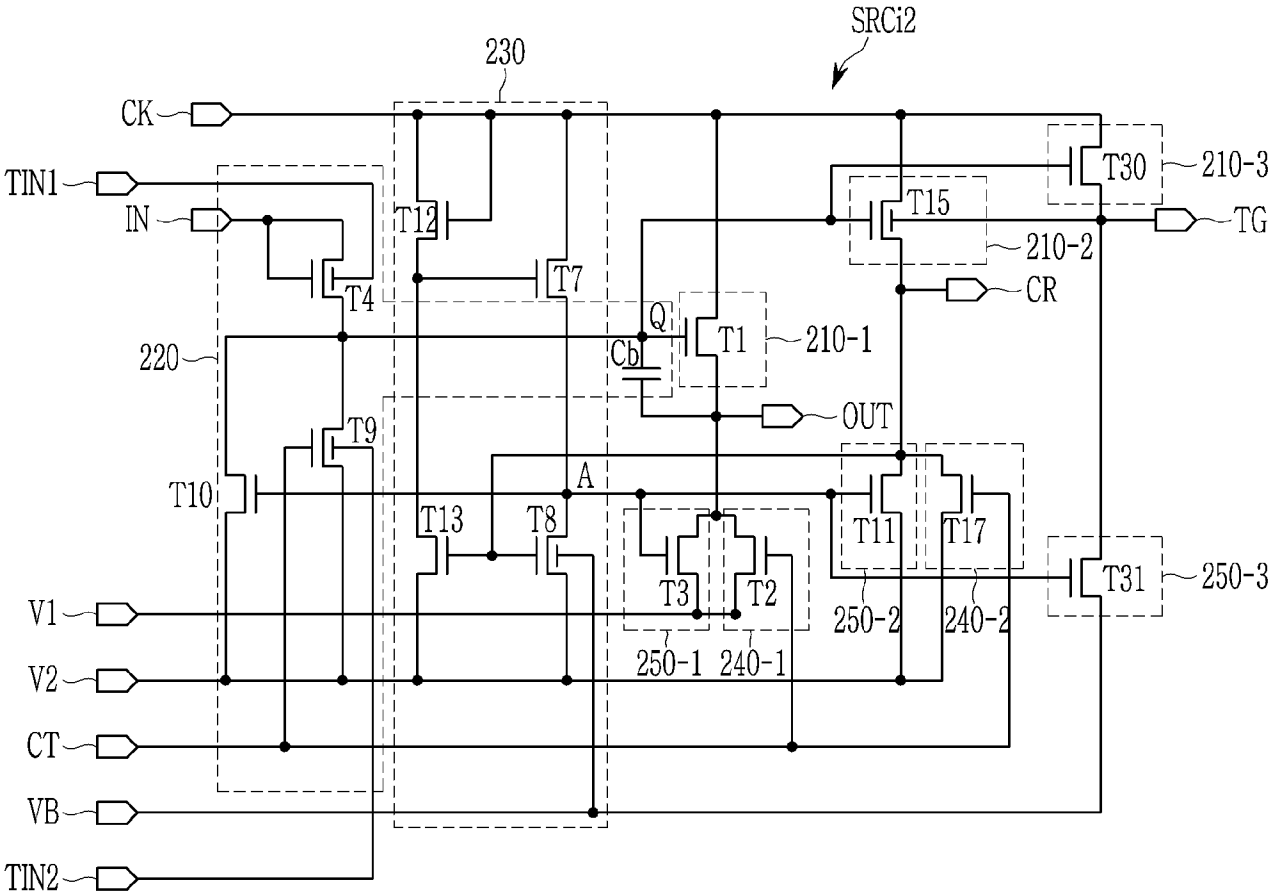
FIG. 9 is a circuit diagram of an alternative exemplary embodiment of the driving stage of FIG. 4.

FIG. 9 is a circuit diagram of an alternative exemplary embodiment of a driving stage of FIG. 4. In an exemplary embodiment, as shown in FIG. 9, the i-th driving stage SRCi2 includes output units 210-1, 210-2 and 210-3, a controller 220, an inverter 230, pull-down units 240-1 and 240-2, and holding units 250-1, 250-2 and 250-3.

The circuit diagram in FIG. 9 is substantially the same as the circuit diagram shown in FIG. 5, except for a connection structure of a third inverter transistor T13 included in the inverter 230, and any repetitive detailed description of same or like elements thereof will hereinafter be omitted or simplified.

The inverter 230 outputs a switching signal to a second node A. The inverter 230 includes first to fourth inverter transistors T12, T7, T13 and T8. Among the first to fourth inverter transistors T12, T7, T13 and T8, the first, second and fourth inverter transistors T12, T7 and T8 have the same configurations as the first, second and fourth inverter transistors T12, T7 and T8 of the inverter 130 of FIG. 5, and any repetitive detailed description thereof will hereinafter be omitted.

In such an embodiment, the third inverter transistor T13 includes an output end connected to an output end of a first inverter transistor T12, a control end connected to a carry terminal CR, and an input end connected to the first ground terminal V1.

In such an embodiment, a leakage current of the third inverter transistor T13 due to a ripple generated from the carry terminal CR may be reduced by reducing a potential difference $V_{GS}$ between the input end and the control end of the third inverter transistor T13.

Figure 10:
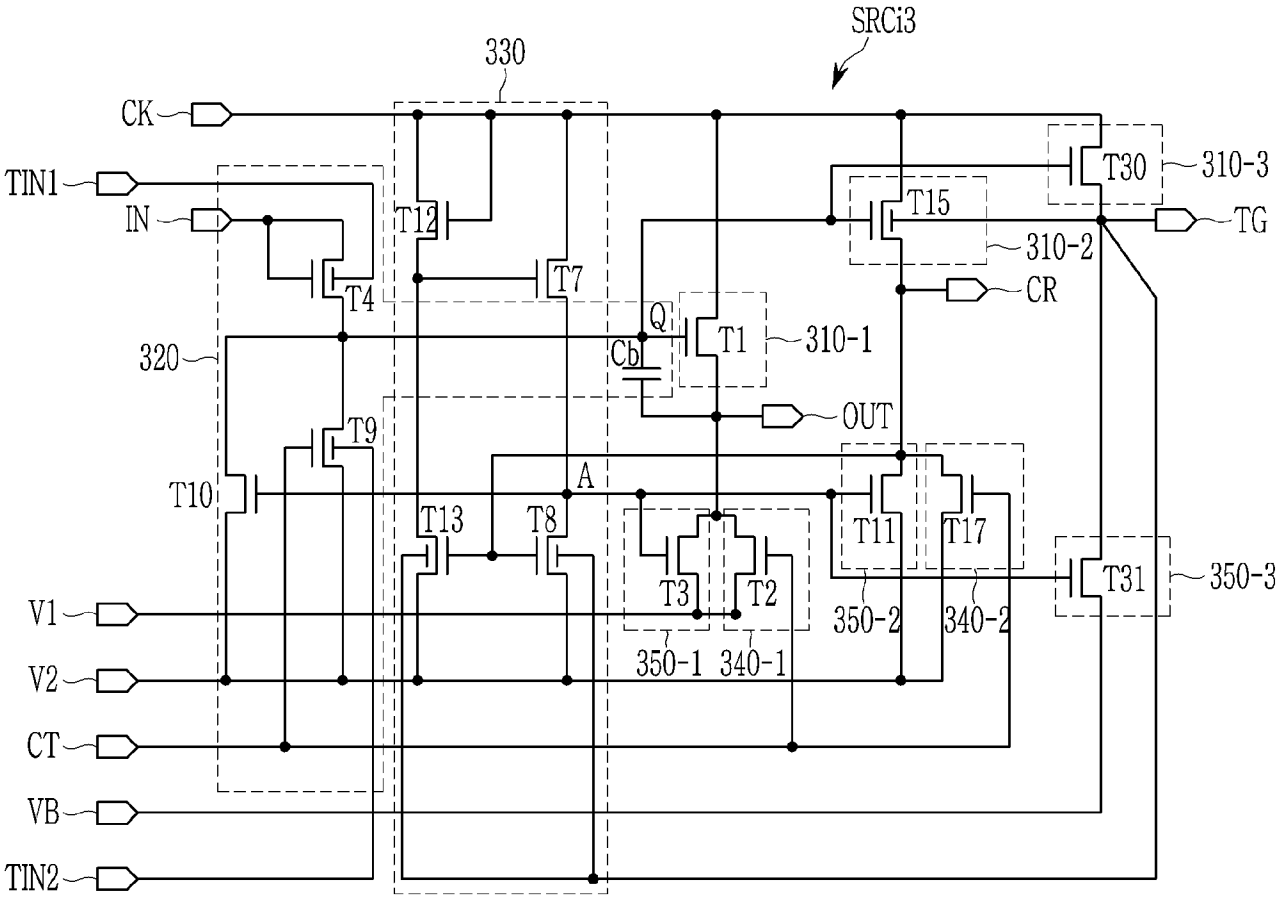
FIG. 10 is a circuit diagram of another alternative exemplary embodiment of the driving stage of FIG. 4.

FIG. 10 is a circuit diagram of another alternative exemplary embodiment of a driving stage of FIG. 4. In an exemplary embodiment, as shown in FIG. 10, the i-th driving stage SRCi3 includes output units 310-1, 310-2 and 310-3, a controller 320, an inverter 330, pull-down units 340-1 and 340-2, and holding units 350-1, 350-2 and 350-3.

The circuit diagram in FIG. 10 is substantially the same as the circuit diagram shown in FIG. 5 except for a connection structure between the third inverter transistor T13 and the fourth inverter transistor T8 included in the inverter 330, and any repetitive detailed description of same or like elements thereof will hereinafter be omitted or simplified.

The inverter 330 outputs a switching signal to a second node A. The inverter 330 includes first to fourth inverter transistors T12, T7, T13 and T8. Among the first to fourth inverter transistors T12, T7, T13 and T8, the first and second inverter transistors T12 and T7 are the same as the first and second inverter transistors T12 and T7 of the inverter 130 of FIG. 5, and any repetitive detailed description thereof will hereinafter be omitted.

In such an embodiment, the third inverter transistor T13 includes an output end connected to an output end of the first inverter transistor T12, a first control end connected to a carry terminal CR, a second control end connected to a compensation terminal TG, and an input end connected to a second ground terminal V2. The fourth inverter transistor T8 includes an output end connected to the second node A, a first control end connected to the carry terminal CR, a second control end connected to the compensation terminal TG, and an input end connected to the second ground terminal V2.

Referring to FIG. 10, together with FIG. 8, a level of a compensation signal TG[i] output from the compensation terminal TG has a low level VL-B that is the same level as the back bias voltage VBB, excluding the i-th period HPi.

In such an embodiment, during a period excluding the i-th period HPi, the compensation signal TG[i] of the low level VL-B is applied to the second control ends of the third and fourth inverter transistors T13 and T8 so that threshold voltages of the third and fourth inverter transistors T13 and T8 are increased. Accordingly, the leakage current of the third and fourth inverter transistors T13 and T8 due to the ripple generated from the carry terminal CR may be reduced.

Figure 11:
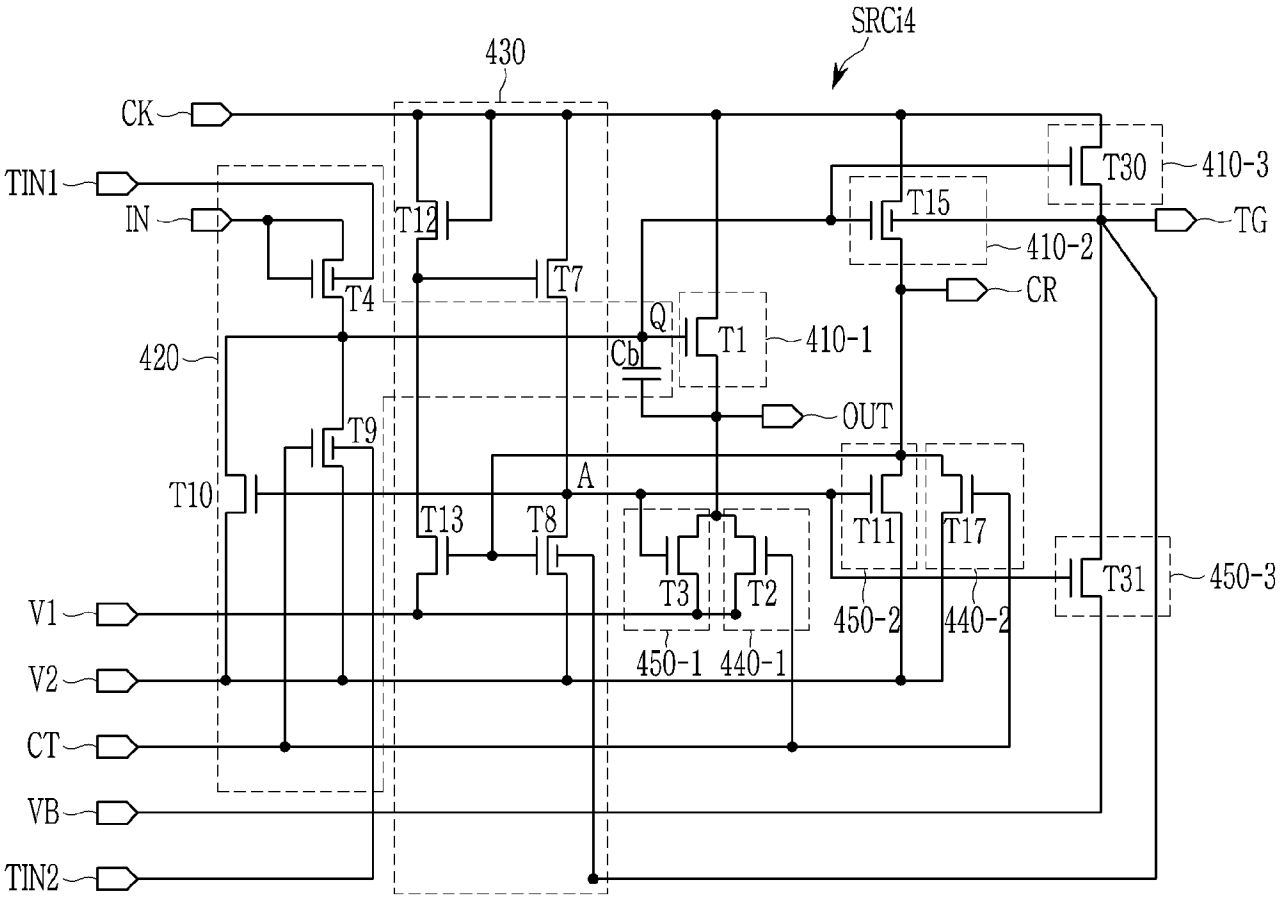
FIG. 11 is a circuit diagram of another alternative exemplary embodiment of the driving stage v.

FIG. 11 is a circuit diagram of another alternative exemplary embodiment of a driving stage of FIG. 4. In an exemplary embodiment, as shown in FIG. 11, the i-th driving stage SRCi4 includes output units 410-1, 410-2, and 410-3, a controller 420, an inverter 430, pull-down units 440-1 and 440-2, and holding units 450-1, 450-2, and 450-3.

The circuit diagram in FIG. 11 is substantially the same as the circuit diagram shown in FIG. 5, except for a connection structure between a third inverter transistor T13 and a fourth inverter transistor T8 included in the inverter 430, and any repetitive detailed description of same or like elements thereof will hereinafter be omitted or simplified.

The inverter 430 outputs a switching signal to a second node A. The inverter 430 includes first to fourth inverter transistors T12, T7, T13 and T8. Among the first to fourth inverter transistors T12, T7, T13 and T8, the first and second inverter transistors T12 and T7 are the same as the first and second inverter transistors T12 and T7 of the inverter 130 of FIG. 5, and any repetitive detailed description thereof will hereinafter be omitted.

The third inverter transistor T13 includes an output end connected to an output end of the first inverter transistor T12, a control end connected to a carry terminal CR, and an input end connected to a second ground terminal V2. The fourth inverter transistor T8 includes an output end connected to the second node A, a first control end connected to the carry terminal CR, a second control end connected to the compensation terminal TG, and an input end connected to the second ground terminal V2.

In such an embodiment, a leakage current of the third inverter transistor T13 due to a ripple generated from the carry terminal CR may be reduced by reducing a potential difference $V_{GS}$ between the input end and the control end of the third inverter transistor T13.

In such an embodiment, a compensation signal TG[i] of a low level VL-B is applied to the second control end of the fourth inverter transistor T8 so that a threshold voltage of the fourth inverter transistor T8 is increased. Accordingly, a current leakage of the fourth inverter transistor T8 due to the ripple generated from the carry terminal CR may be reduced.

Figure 12:
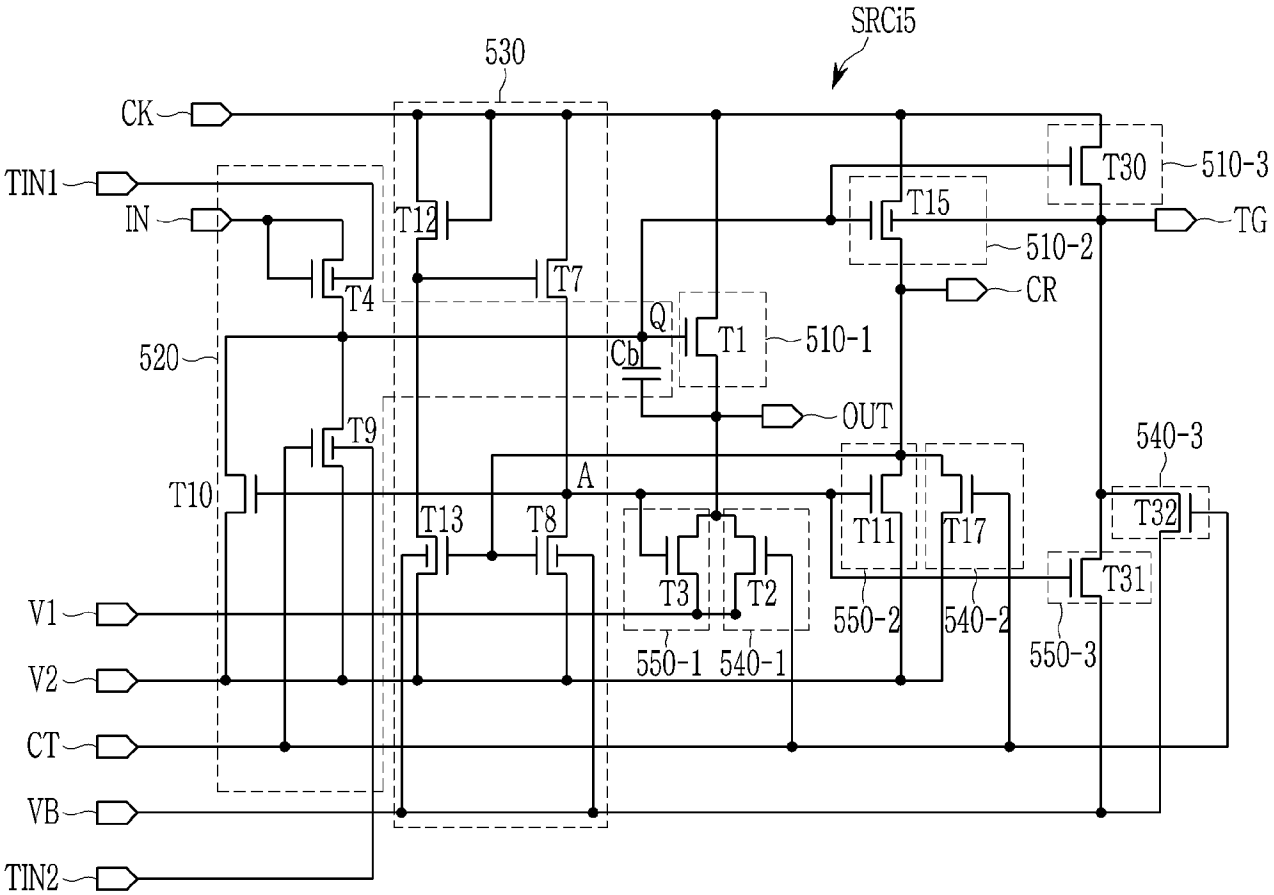
FIG. 12 is a circuit diagram of another alternative exemplary embodiment of the driving stage of FIG. 4.

FIG. 12 is a circuit diagram of another alternative exemplary embodiment of a driving stage of FIG. 4. In an exemplary embodiment, as shown in FIG. 12, the i-th driving stage SRCi5 includes output units 510-1, 510-2 and 510-3, a controller 520, an inverter 530, pull-down units 540-1, 540-2 and 540-3, and holding units 550-1, 550-2 and 550-3.

The circuit diagram in FIG. 12 is substantially the same as the circuit diagram shown in FIG. 5 except for the pull-down unit 540-3, and any repetitive detailed description of same or like elements will hereinafter be omitted or simplified.

In an exemplary embodiment, the pull-down unit 540-3 includes a third pull-down transistor T32. The third pull-down transistor T32 is connected between a compensation terminal TG and a bias voltage terminal VB, and includes a control end connected to a control terminal CT.

A voltage of an i-th compensation signal TG[i] after an (i+1)-th period HP(i+1) corresponds to a voltage of an output end of the third output transistor T30. During the (i+1)-th period HP(i+1), the third pull-down transistor T32 provides a back bias voltage VBB to an output end of the third output transistor T30 in response to an (i+1)-th carry signal.

In such an embodiment, the third pull-down transistor T32 provides the back bias voltage VBB to the compensation terminal TG in the (i+1)-th period HP(i+1) to increase a threshold voltage of a second output transistor T15. Accordingly, a leakage current of the second output transistor T15 is reduced, thereby reducing a ripple at the carry terminal CR.

Figure 13:
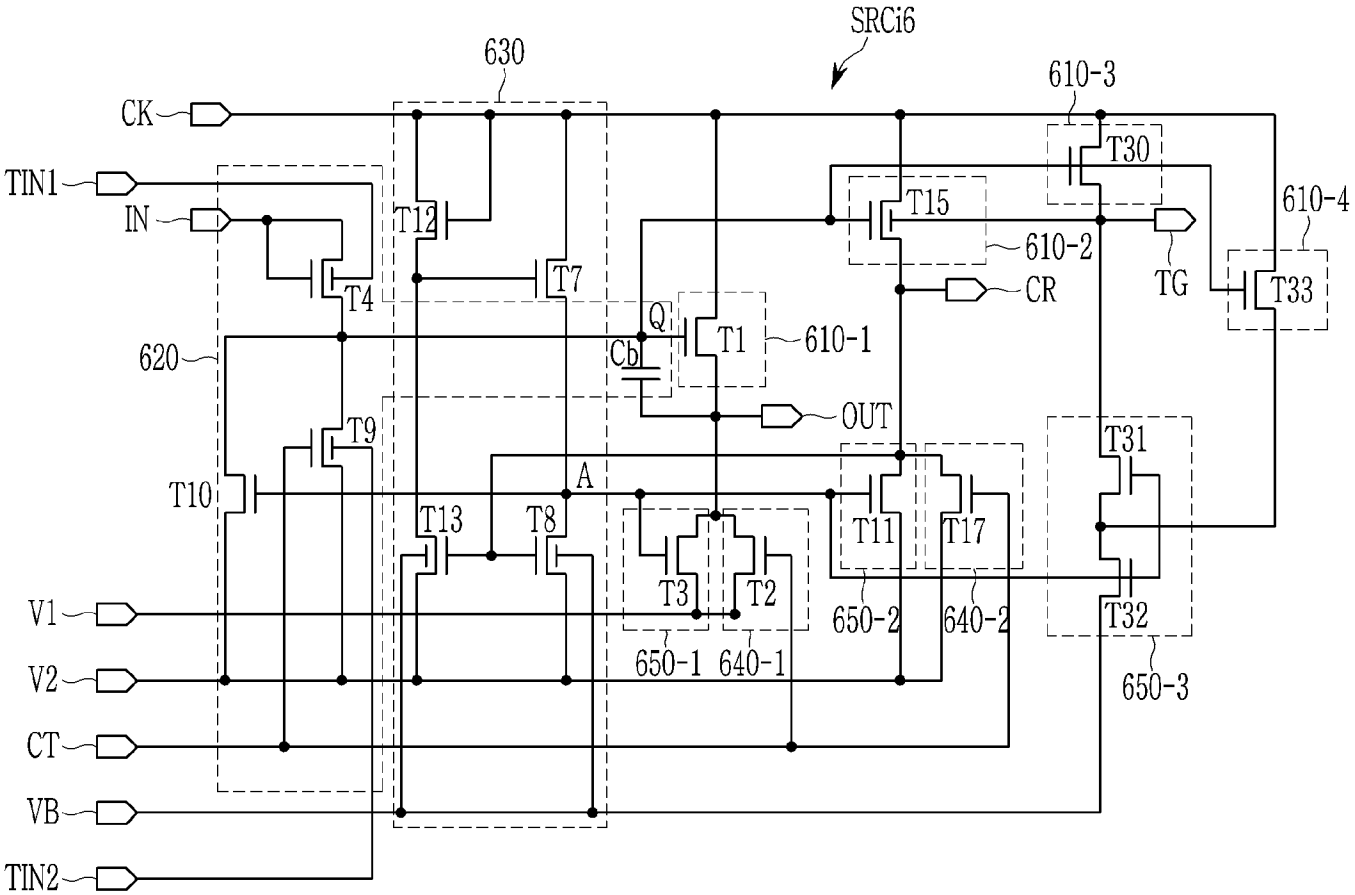
FIG. 13 is a circuit diagram of another alternative exemplary embodiment of the driving stage of FIG. 4.

FIG. 13 is a circuit diagram of another alternative exemplary embodiment of a driving stage of FIG. 4. In an exemplary embodiment, as shown in FIG. 13, the i-th driving stage SRCi6 includes output units 610-1, 610-2, 610-3 and 610-4, a controller 620, an inverter 630, pull-down units 640-1 and 640-2, and holding units 650-1, 650-2 and 650-3.

The circuit diagram in FIG. 13 is substantially the same as the circuit diagram shown in FIG. 5 except that an output unit 610-4 is added and a structure of a holding unit 650-3 is changed, and any repetitive detailed description of same or like elements will hereinafter be omitted or simplified.

The holding unit 650-3 includes third and fourth holding transistors T31 and T32. The third and fourth holding transistors T31 and T32 are connected between a compensation terminal TG and a bias voltage terminal VB, and respectively include control ends connected to a second node A.

The output unit 610-4 includes a fourth output transistor T33. The fourth output transistor T33 includes an input end connected to a clock terminal CK, a control end connected to a first node Q, and an output end connected between the third holding transistor T31 and the fourth holding transistor T32.

Referring to FIG. 13 together with FIG. 8, when a noise is generated in a voltage of the second node A in the i-th period HPi, a compensation signal TG[i] output to the compensation terminal TG through the third holding transistor T31 and the fourth holding transistor T32 may be discharged.

In the i-th period HPi, the fourth output transistor T33 may provide a first clock signal CKV of a high level VH-C to a node between the third holding transistor T31 and the fourth holding transistor T32. Then, even when the third holding transistor T31 is turned on in the i-th period HPi, the compensation signal TG[i] output to the compensation terminal TG may be maintained at a sufficiently high level.

Hereinafter, alternative exemplary embodiments of a gate driving circuit will be described with reference to FIG. 14 to FIG. 17.

Figure 14:
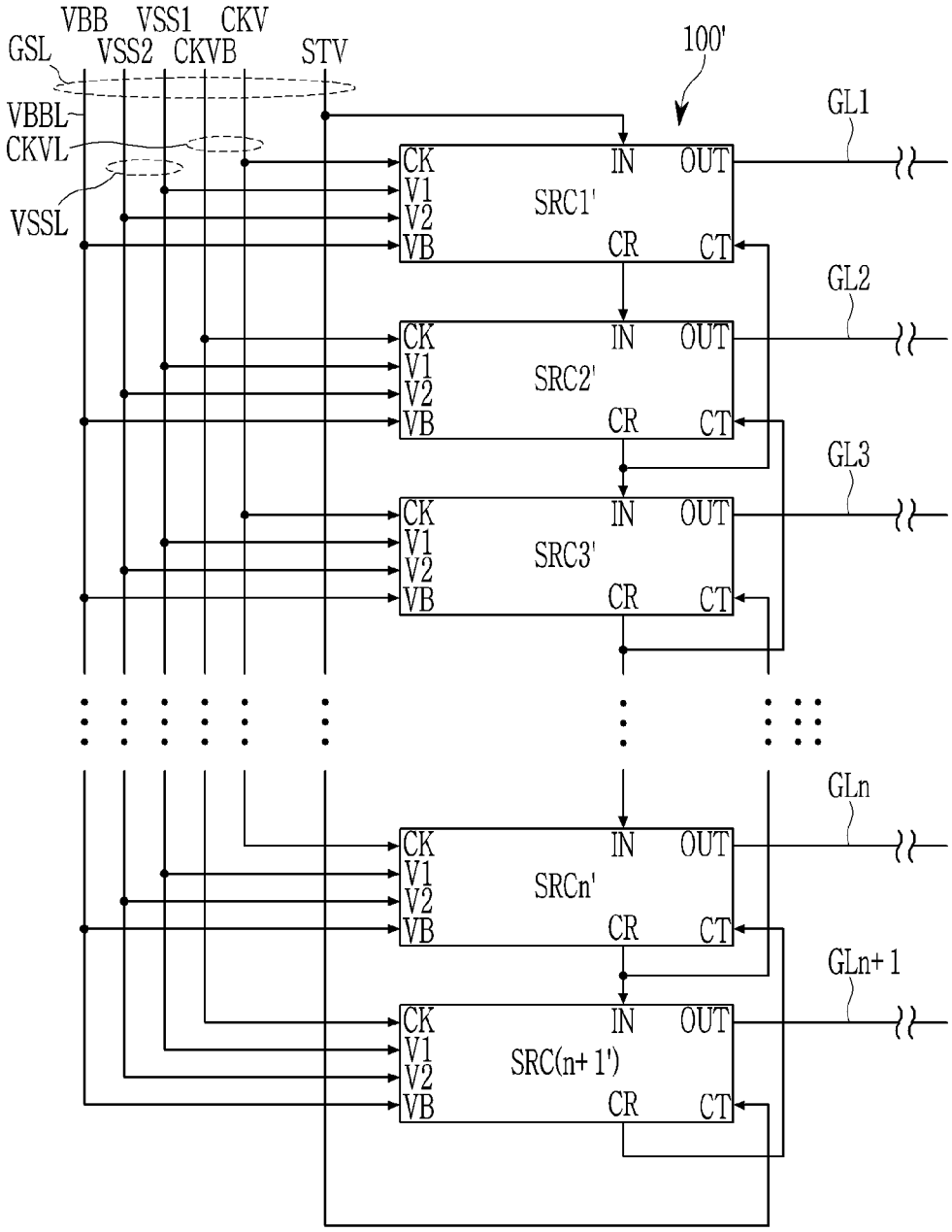
FIG. 14 is a block diagram of a gate driving circuit according to an alternative exemplary embodiment.

FIG. 14 is a circuit block diagram of a gate driving circuit according to an alternative exemplary embodiment. As shown in FIG. 14, an exemplary embodiment of a gate driving circuit 100' includes a plurality of driving stages SRC1' to SRCn' and a dummy driving stage SRC(n+1)'. The plurality of driving stages SRC1' to SRCn' and the dummy driving stage SRC(n+1)' have a dependent connection relationship (e.g., a cascade connection) in which each driving stage operates in response to a carry signal output from a previous stage thereof and a carry signal output from a next stage thereof.

Each of the plurality of driving stages SRC1' to SRCn' receives a first or second clock signal CKV or CKVB, a first ground voltage VSS1, a second ground voltage VSS2, and a back bias voltage VBB from the signal controller 300 shown in FIG. 1 through a signal line GSL. The driving stage SRC1' and the dummy driving stage SRC(n+1)' further receive a start signal STV.

The signal line GSL includes a back bias voltage signal line VBBL for transmitting a back bias voltage VBB, clock signal lines CKVL for transmitting the first clock signal CKV and the second clock signal CKVB, and ground voltage lines VSSL for transmitting the first ground voltage VSS1 and the second ground voltage VSS2.

In an exemplary embodiment, the plurality of driving stages SRC1' to SRCn' are respectively connected to a plurality of gate lines GL1 to GLn. The plurality of driving stages SRC1' to SRCn' respectively provide gate signals to the plurality of gate lines GL1 to GLn. In such an embodiment, the gate lines connected to the plurality of driving stages SRC1' to SRCn' may be divided into odd-numbered gate lines or even-numbered gate lines.

Each of the plurality of driving stages SRC1' to SRCn' and the dummy driving stage SRC(n+1') includes an output terminal OUT, a carry terminal CR, an input terminal IN, a control terminal CT, a clock terminal CK, a first ground terminal V1, a second ground terminal V2, and a bias voltage terminal VB.

The output terminal OUT of each of the plurality of driving stages SRC1' to SRCn' is connected to a corresponding gate line among the plurality of gate lines GL1 to GLn. Gate signals generated from the plurality of driving stages SRC1' to SRCn' are provided to the plurality of gate lines GL1 to GLn through the respective output terminals OUT.

The carry terminal CR of each of the plurality of driving stages SRC1' to SRCn' is electrically connected to an input terminal IN of the next driving stage thereof. The carry terminals CR of the plurality of driving stages SRC1' to SRCn' respectively output carry signals.

The input terminal IN of each of the plurality of driving stages SRC2' to SRCn' and the dummy driving stage SRC (n+1)' receives the carry signal of the previous driving stage thereof. In one exemplary embodiment, for example, the input terminal IN of the third driving stages SRC3' receives a carry signal of the second driving stage SRC2'. The input terminal IN of the first driving stage SRC1' receives the start signal STV that starts driving of the gate driving circuit 100' instead.

The control terminal CT of each of the plurality of driving stages SRC1' to SRCn' is electrically connected to the carry terminal CR of the next driving stage thereof, and receives the carry signal of the next driving stage thereof.

In one exemplary embodiment, for example, the control terminal CT of the second driving stage SRC2' receives a carry signal output from the carry terminal CR of the third driving stage SRC3'. In an alternative exemplary embodiment, the control terminal CT of each of the plurality of driving stages SRC1' to SRCn' may be electrically connected to the output terminal OUT of the next driving stage thereof.

The control terminal CT of the driving stage SRCn' disposed at the end receives a carry signal output from the carry terminal CR of the dummy driving stage SRC(n+1)'. The control terminal CT of the dummy driving stage SRC (n+1)' receives the start signal STV.

The clock terminal CK of each of the plurality of driving stages SRC1' to SRCn' and the dummy driving stage SRC (n+1)' receives one of the first clock signal CKV and the second clock signal CKVB. Among the plurality of driving stages SRC1' to SRCn', clock terminals CK of odd-numbered driving stages SRC1' and SRC3' may respectively receive the first clock signal CKV. Among the plurality of driving stages SRC1' to SRCn', clock terminals CK of even-numbered driving stages SRC2' and SRCn' may respectively receive the second clock signal CKVB, where n is an even number. The first clock signal CKV and the second clock signal CKVB may have different phases from each other.

The first ground terminals V1 of the plurality of driving stages SRC1' to SRCn' and the dummy driving stage SRC (n+1)' receive the first ground voltage VSS1. The second ground terminals V2 of the plurality of driving stages SRC1' to SRCn' and the dummy driving stage SRC(n+1)' respectively receive the second ground voltage VSS2. The first ground voltage VSS1 and the second ground voltage VSS2 have different voltage levels from each other, and second ground voltage VSS2 has a voltage level that is lower than that of the first ground voltage VSS1.

The bias voltage terminals VB of the plurality of driving stages SRC1' to SRCn' and the dummy driving stage SRC (n+1)' receive the back bias voltage VBB.

Next, an exemplary embodiment of a driving stage of FIG. 14 will be described in detail with reference to FIG. 15.

Figure 15:
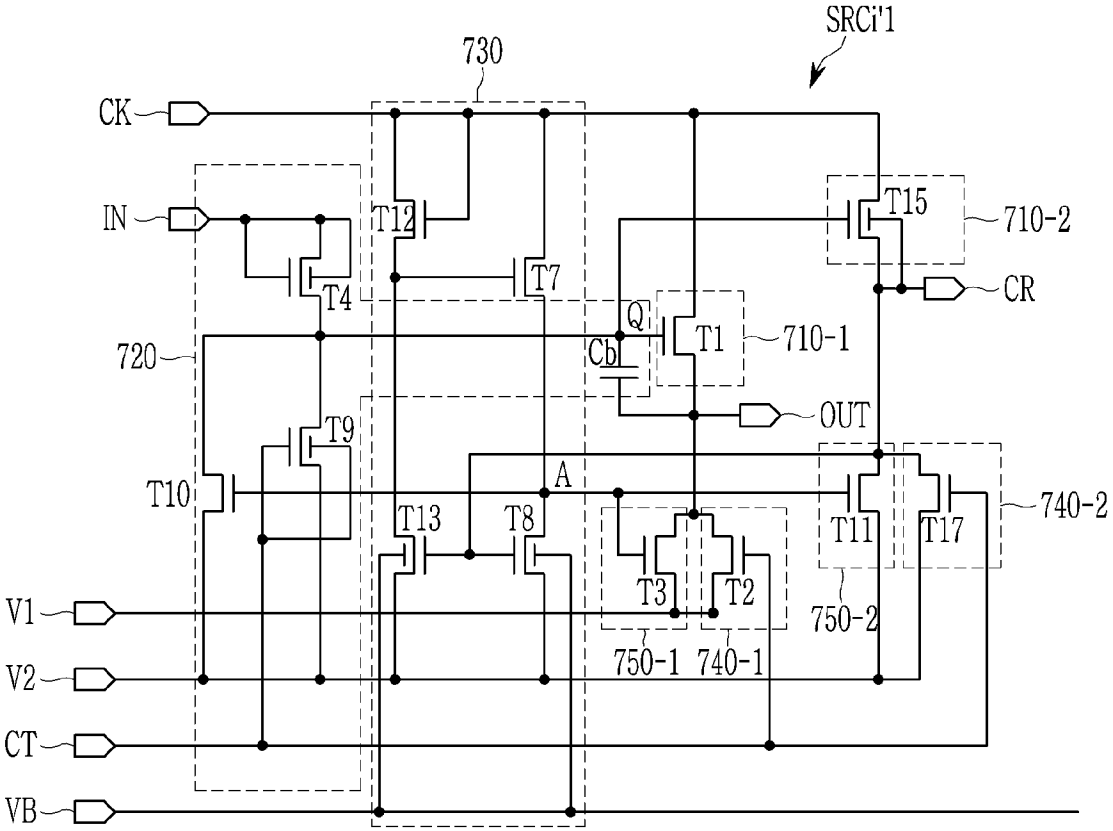
FIG. 15 is a circuit diagram of an exemplary embodiment of a driving stage of FIG. 14.

FIG. 15 shows a circuit diagram of an exemplary embodiment of a driving stage of FIG. 14.

FIG. 15 illustrates an exemplary embodiment of an i-th driving stage SRCi'1 (here, i is a positive integer) among the plurality of driving stages SRC1' to SRCn' shown in FIG. 14. Each of the plurality of driving stages SRC1' to SRCn' of FIG. 14 may have the same circuit structure as the i-th driving stage SRCi'1.

Referring to FIG. 15, an exemplary embodiment of the i-th driving stage SRCi'1 includes output units 710-1 and 710-2, a controller 720, an inverter 730, pull-down units 740-1 and 740-2, and holding units 750-1 and 750-2.

The output unit 710-1 outputs an i-th gate signal, and the output unit 710-2 outputs an i-th carry signal.

The pull-down unit 740-1 pulls down the output terminal OUT to the first ground voltage VSS1 connected to the first ground terminal V1. The pull-down unit 740-2 pulls down the carry terminal CR to the second ground voltage VSS2 connected to the second ground terminal V2.

The holding unit 750-1 maintains the output terminal OUT in the pulled-down state. The holding unit 750-2 maintains the carry terminal CR in the pulled-down state.

The controller 720 controls operation of the output units 710-1 and 710-2, the pull-down units 740-1 and 740-2, and the holding units 750-1 and 750-2.

Hereinafter, the configuration of the i-th driving stage SRCi'1 will be described in greater detail.

In an exemplary embodiment, the output unit 710-1 includes a first output transistor T1. The first output transistor T1 includes an input end connected to the clock terminal CK, a control end connected to the first node Q, and an output end that outputs the i-th gate signal.

The output unit 710-2 includes a second output transistor T15. The second output transistor T15 includes an input end connected to the clock terminal CK, a first control end connected to the first node Q, an output end that outputs an i-th carry signal, and a second control end connected to the carry terminal CR.

As shown in FIG. 14, clock terminals CK of some (SRC1', SRC3', and SRCn−1') of the driving stages SRC1' to SRCn' and the dummy driving stage SRC(n+1)' receive the first clock signal CKV. Clock terminals CK of the remaining driving stages (SRC2', SRC4', . . . , and SRCn') of the driving stages SRC1' to SRCn' receive the second clock signal CKVB. The first clock signal CKV and the second clock signal CKVB are complimentary signals. In an exemplary embodiment, the first clock signal CKV and the second clock signal CKVB may have a phase difference of about 180°.

The controller 720 turns on the first output transistor T1 and the second output transistor T15 in response to an (i−1)-th carry signal received through the input terminal IN from the previous driving stage.

The controller 720 turns off the first output transistor T1 and the second output transistor T15 in response to an (i+1)-th carry signal received through the control terminal CT from the next driving stage. The controller 720 provides the second ground voltage VSS2 to the first node Q in response to a switching signal output from the inverter 130.

The controller 720 includes a first control transistor T4, a second control transistor T9, a third control transistor T10, and a capacitor Cb.

The first control transistor T4 is connected between the input terminal IN and the first node Q, and includes a first control end and a second control end connected together with the input terminal IN.

The second control transistor T9 is connected between the first node Q and the second ground terminal V2, and includes a first control end and a second control end connected together with the control terminal CT.

The third control transistor T10 is connected between the first node Q and the second ground terminal V2, and includes a control end connected to a second node A.

The capacitor Cb is connected between the output terminal OUT and a control end of the controller 720 (e.g., the first node Q).

The inverter 130 outputs a switching signal to the second node A. The inverter 130 includes first to fourth inverter transistors T12, T7, T13, and T8.

The first inverter transistor T12 includes an input end, a control end and an output end. The input end and the control end of the first inverter transistor T12 are commonly connected to the clock terminal CK, and the output end of the first inverter transistor T12 is connected to a control end of the second inverter transistor T7. The second inverter transistor T7 includes an input end connected to the clock terminal CK, an output end connected to the second node A, and a control end connected to the output end of the first inverter transistor T12.

The third inverter transistor T13 includes an output end connected to the output end of the first inverter transistor T12, a first control end connected to the carry terminal CR, a second control end connected to the bias voltage terminal VB, and an input end connected to the second ground terminal V2. The fourth inverter transistor T8 includes an output end connected to the second node A, a first control end connected to the carry terminal CR, a second control end connected to the bias voltage terminal VB, and an input end connected to the second ground terminal V2. In an alternative exemplary embodiment, first control ends of the third and fourth inverter transistors T13 and T8 may be connected to the output terminal OUT.

The pull-down unit 740-1 includes a first pull-down transistor T2. The first pull-down transistor T2 is connected between the output terminal OUT and the first ground terminal V1, and includes a control end connected to the control terminal CT.

The pull-down unit 740-2 includes a second pull-down transistor T17. The second pull-down transistor T17 is connected between the carry terminal CR and the second ground terminal V2, and includes a control end connected to the control terminal CT.

The holding unit 750-1 includes a first holding transistor T3. The first holding transistor T3 is connected between the output terminal OUT and the first ground terminal V1, and includes a control end connected to the second node A.

The holding unit 750-2 includes a second holding transistor T11. The second holding transistor T11 is connected between the carry terminal CR and the first ground terminal V1, and includes a control end connected to the second node A.

Among transistors in the driving stage SRCi'1 shown in FIG. 15, the second output transistor T15, the first control transistor T4, the second control transistor T9, the third inverter transistor T13 and the fourth inverter transistor T8 are 4-terminal transistors, threshold voltages of which may be adjusted.

In such an embodiment, each of the second output transistor T15, the first control transistor T4, the second control transistor T9, the third inverter transistor T13 and the fourth inverter transistor T8 further includes the second control end in addition to the input end, the output end and the first control end.

In an exemplary embodiment shown in FIG. 15, the second output transistor T15, the first control transistor T4, the second control transistor T9, the third inverter transistor T13 and the fourth inverter transistor T8 are 4-terminal transistors, but not being limited thereto. In an alternative exemplary embodiment, at least one of the second output transistor T15, the first control transistor T4, the second control transistor T9 and the fourth inverter transistor T8 may not be a 4-terminal transistor.

A structure and a threshold voltage change of the 4-terminal transistors are the same as those described above with reference to FIG. 6 and FIG. 7, and any repetitive detailed description thereof will be omitted.

Figure 16:
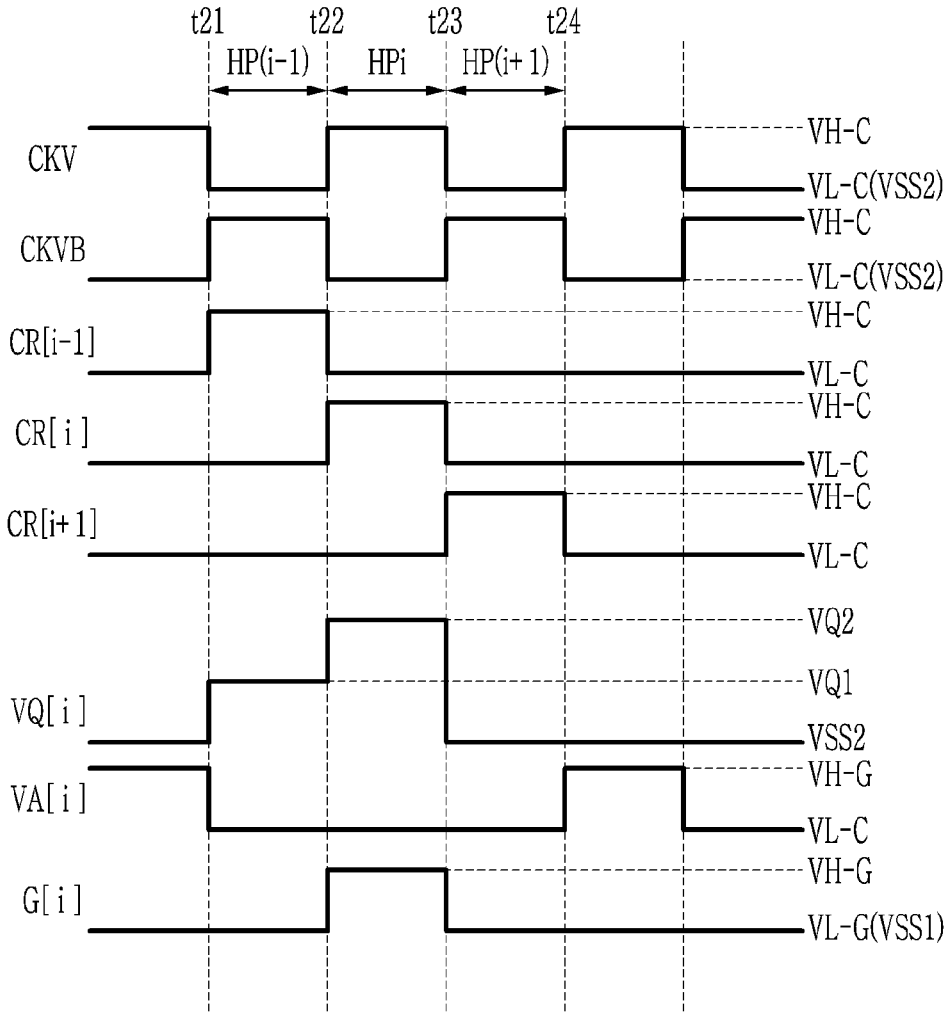
FIG. 16 is a timing diagram of signals of a display device according to an alternative exemplary embodiment.

FIG. 16 is a timing diagram of signals of a display device according to an alternative exemplary embodiment.

As shown in FIG. 16, a first clock signal CKV and a second clock signal CKVB may be signals having phases inverted from each other. The first clock signal CKV and the second clock signal CKVB may have a phase difference of about 180°. The first clock signal CKV and the second clock signal CKVB respectively have a low level VL-C, a voltage level of which is low, and a high level VH-C, a voltage level of which is relatively high. The high level VH-C may have a voltage level of about 10 V. The low level VL-C may have a voltage level of about −14 V. The low level VL-C may have the same voltage level as the second ground voltage VSS2.

One frame period includes a period, during which a voltage level of an i-th gate signal G[i] is the low level VL-G, and a period, during which a voltage level of the i-th gate signal G[i] is the relatively high level VH-G. The low level VL-G of the i-th gate signal G[i] may be the same voltage level as the first ground voltage VSS1. The low level VL-G may be about −12 V.

During some periods, the i-th gate signal G[i] may have the same voltage level as the low level VL-C of the first clock signal CKV or the second clock signal CKVB. A low level VL-C of the first clock signal CKV or the second clock signal CKVB is output by a pre-charged first node Q before the i-th gate signal G[i] reaches the high level VH-G.

The high level VH-G of the i-th gate signal G[i] may have the same level as the high level VH-C of the first clock signal CKV or the second clock signal CKVB.

The i-th carry signal CR[i] may have the low level VL-C having a low voltage level and the high level VH-C having a relatively high voltage level. Since the i-th carry signal CR[i] is generated based on the first clock signal CKV, the i-th carry signal CR[i] has a voltage level that is the same as or similar to the first clock signal CKV.

Referring back to FIG. 15, the controller 720 controls operations of the output units 710-1 and 710-2. The controller 720 turns on the output units 710-1 and 710-2 in response to an (i−1)-th carry signal CR[i−1] output from an (i−1)-th driving stage. The controller 720 turns off the output units 710-1 and 710-2 in response to an (i+1)-th carry signal CR[i+1] output from an (i+1)-th driving stage. In such an embodiment, the controller 720 maintains the turned-off state of the output units 710-1 and 710-2 according to the switching signal output from the inverter 730.

FIG. 16 displays a period HPi (hereinafter referred to as an i-th period) during which the i-th gate signal G[i] has a high level VH-G, the previous period HP(i−1) (referred to as an (i−1)-th period), and the next period HP(i+1) (referred to as an (i+1)-th period), among a plurality of periods.

The first control transistor T4 outputs a control signal, which controls a potential of the first node Q, to the first node Q. The second control transistor T9 provides the second ground voltage VSS2 to the first node Q in response to the (i+1)-th carry signal CR[i+1] output from the (i+1)-th stage. The third control transistor T10 provides the second ground voltage VSS2 to the first node Q in response to a switching signal output from the inverter 730.

As shown in FIGS. 15 and 16, a potential or voltage level of the first node Q (VQ[i] in FIG. 16) is increased to a first high level VQ1 by the (i−1)-th carry signal CR[i−1] during an (i−1)-th period HP(i−1).

During the i-th period HPi, the i-th gate signal G[i] is output. When the i-th gate signal G[i] is output, the first node Q is boosted to a second high level VQ2 from the first high level VQ1.

During the i-th period HPi, the (i−1)-th carry signal CR[i−1] of the low level VL-C of the previous driving stage is applied to the second control end of the first control transistor T4. During the i-th period HPi, an (i+1)-th carry signal CR[i+1] of the low level VL-C of the next driving stage is applied to the second control end of the second control transistor T9.

The i-th carry signal CR[i−1] of the low level VL-C of the previous driving stage and the (i+1)-th carry signal CR[i+1] of the low level VL-C of the next driving stage have voltages that are similar to or equal to the back bias voltage VBB. Therefore, the threshold voltages of the first and second control transistors T4 and T9 are increased (i.e., positive-shifted).

Since the threshold voltages of the first and second control transistors T4 and T9 are increased, the first node Q is boosted to the second high level VQ2, and thus, even though a voltage difference at lateral ends of the first control transistor T4 is increased, a leakage current according to the increase of the voltage difference at lateral ends of the first control transistor T4 is reduced. In such an embodiment, although a voltage difference between lateral ends of the second control transistor T9 is increased, a leakage current according to the increase of the voltage difference between lateral ends of the second control transistor T9 is reduced. Accordingly, the potential of the first node Q is maintained at the second high level VQ2 so that the i-th gate signal G[i] may be output with a sufficiently high level.

During the i-th period HPi, the i-th carry signal CR[i] is output. In a period excluding the i-th period HPi, the carry signal CR[i] of the low level VL-C is applied to the second control end of the second output transistor T15. Then, the threshold voltage of the second output transistor T15 is increased (i.e., positive-shifted). Thus, a leakage current of the second output transistor T15 is reduced so that a ripple at the carry terminal CR can be reduced.

During the (i+1)-th period HP(i+1), the second control transistor T9 provides the second ground voltage VSS2 to the first node Q in response to the (i+1)-th carry signal CR[i+1] output from the (i+1)-th stage.

At the time point t23 at which the (i+1)-th period HP(i+1) starts, the voltage of the first node Q is reduced to the second ground voltage VSS2. Accordingly, the first output transistor T1 and the second output transistor T15 are turned off. Until the (i−1)-th gate signal G[i−1] of the next frame period is output after the (i+1)-th period HP(i+1), the voltage of the first node Q is maintained at the second ground voltage VSS2. Thus, until the (i−1)-th gate signal G[i−1] of the next frame period is output after the (i+1)-th period HP(i+1), the first output transistor T1 and the second output transistor T15 maintain the turned-off state.

The voltage of the second node A (VA[i] in FIG. 16) has substantially the same phase as the first clock signal CKV, excluding the i-th period HPi. In a period excluding the i-th period HPi, a ripple generated from the carry terminal CR may be applied to the first control ends of the third and fourth inverter transistors T13 and T8. The second ground voltage VSS2 is applied to the input ends of the third and fourth inverter transistors T13 and T8. A leakage current may flow through the third and fourth inverter transistors T13 and T8 due to a potential difference between the first control ends and the input ends of the third and fourth inverter transistors T13 and T8.

In such an embodiment, the first clock signal CKV transmitted to the control end of the second inverter transistor T7 through the first inverter transistor T12 may be discharged through the third inverter transistor T13. Then, the voltage of the second node A has a phase that is different from that of the first clock signal CKV. Accordingly, the third control transistor T10, the second holding transistor T11 and the third holding transistor T31, control ends of which are connected to the second node A, may not effectively operate.

According to an exemplary embodiment, the back bias voltage VBB is applied to the second control ends of the third and fourth inverter transistors T13 and T8 to increase the threshold voltages of the third and fourth inverter transistors T13 and T8. Thus, the leakage current of the third and fourth inverter transistors T13 and T8 due to the ripple generated at the carry terminal CR may be reduced.

According to an exemplary embodiment, the input end of the third inverter transistor T13 is connected to the first ground terminal V1. In such an embodiment, a potential difference $V_{GS}$ between the input end and the control end of the third inverter transistor T13 is reduced to thereby reduce the leakage current of the third inverter transistor T13 caused by the ripple generated at the carry terminal CR.

In such an embodiment, during the i-th period HPi, the third and fourth inverter transistors T13 and T8 are turned on in response to the i-th carry signal R[i]. When the third and fourth inverter transistors T13 and T8 are turned on, the first clock signal CKV of the high level VH-C, output from the second inverter transistor T7, is synchronized with the second ground voltage VSS2 through the fourth inverter transistor T8, such that the second ground voltage VSS2 may be applied to the second node A.

In other periods, excluding the i-th period HPi, the first clock signal CKV of the high level VH-C output from the second inverter transistor T7 is provided to the second node A.

A voltage of the i-th gate signal G[i] after the (i+1)-th period HP(i+1) corresponds to a voltage of the output terminal OUT. During the (i+1)-th period HP(i+1), the first pull-down transistor T2 provides the first ground voltage VSS1 to the output terminal OUT in response to the (i+1)-th carry signal.

A voltage of the i-th carry signal CR[i] after the (i+1)-th period HP(i+1) corresponds to a voltage of the carry terminal CR. During the (i+1)-th period HP(i+1), the second pull-down transistor T17 provides the second ground voltage VSS2 to the carry terminal CR in response to the (i+1)-th carry signal.

After the (i+1)-th period HP(i+1), the first holding transistor T3 provides the first ground voltage VSS1 to the output terminal OUT in response to a switching signal output from the second node A.

After the (i+1)-th period HP(i+1), the second holding transistor T11 provides the second ground voltage VSS2 to the carry terminal CR in response to a switching signal output from the second node A.

Next, an alternative exemplary embodiment of the driving stage of FIG. 14 will be described with reference to FIG. 17.

Figure 17:
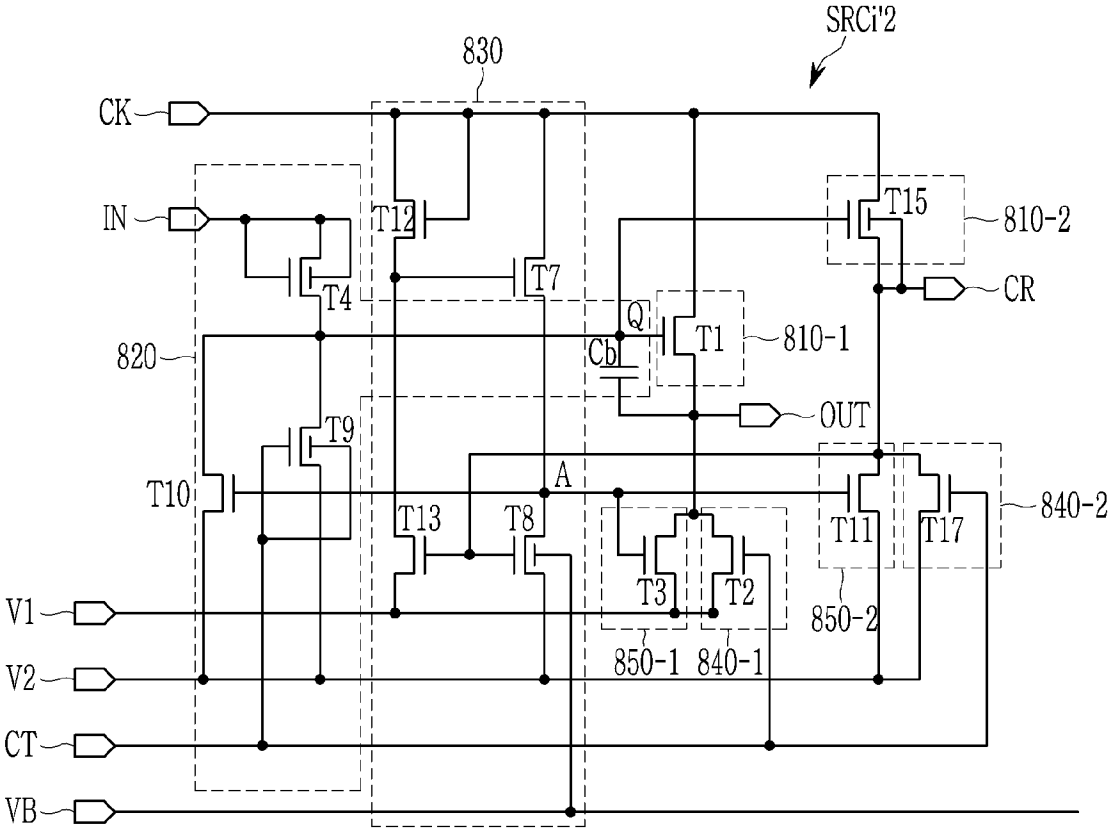
FIG. 17 is a circuit diagram of an alternative exemplary embodiment of the driving stage of FIG. 14.

FIG. 17 is a circuit diagram of an alternative exemplary embodiment of a driving stage of FIG. 14. In an exemplary embodiment, as show in FIG. 17, the i-th driving stage SRCi'2 includes output units 810-1 and 810-2, a controller 820, an inverter 830, pull-down units 840-1 and 840-2, and holding units 850-1 and 850-2.

The circuit diagram in FIG. 17 is substantially the same as the circuit diagram shown in FIG. 15, except for a connection structure of a third inverter transistor T13 included in the inverter 830, and any repetitive detailed description of same or like elements will hereinafter be omitted or simplified.

In such an embodiment, the inverter 830 outputs a switching signal to the second node A. The inverter 830 includes first to fourth inverter transistors T12, T7, T13 and T8. Among the first to fourth inverter transistors T12, T7, T13 and T8, the first, second and fourth transistors T12, T7 and T8 are the same as the first, second and fourth transistors T12, T7, and T8 of the inverter 730 of FIG. 15, and any repetitive detailed description thereof will be omitted.

In such an embodiment, the third inverter transistor T13 includes an output end connected to an output end of the first inverter transistor T12, a control end connected to a carry terminal CR, and an input end connected to a first ground terminal V1.

In such an embodiment, a leakage current of the third inverter transistor T13 due to a ripple generated from the carry terminal CR may be reduced by reducing a potential difference $V_{GS}$ between the input end and the control end of the third inverter transistor T13.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A gate driving circuit comprising:

a plurality of stages which outputs gate signals to corresponding gate lines, respectively, wherein a stage of the plurality of stages comprises:

a first control transistor diode-connected between a first input end of the stage and a first node, wherein the first control transistor has a double-gate structure having both a control electrode and a back gate electrode, the control electrode of the first control transistor is biased by a first input signal of the first input end of the stage and directly connected to the first input end of the stage, and the back gate electrode of the first control transistor is biased by a second input signal of a second input end of the stage;

a second control transistor comprising a first end connected to the first node, a second end connected to a first voltage, and a double-gate structure having both a control electrode and a back gate electrode, wherein the control electrode of the second control transistor is connected to a third input end of the stage and receives a third input signal, and the back gate electrode of the second control transistor is biased by a fourth input signal of a fourth input end of the stage;

a first output transistor comprising a control end connected to the first node, a first end connected to a clock input end of the stage, and a second end connected to a first output end of the stage; and a capacitor connected between the control end of the first output transistor and the second end of the first output transistor, wherein the second input signal and the fourth input signal have enable levels during different periods from each other.

2. The gate driving circuit of claim 1, wherein the stage of the plurality of stages further comprises:

a second output transistor comprising a control end connected to the first node, a first end connected to the clock input end, and a second end connected to a second output end of the stage to output a carry signal; and a third output transistor comprising a control end connected to the first node, a first end connected to the clock input end, and a second end connected to a third output end of the stage to output a compensation signal, wherein a back gate electrode of the second output transistor is biased by the compensation signal.

3. The gate driving circuit of claim 2, wherein the second input signal is a compensation signal output from a previous stage of the stage, among the plurality of stages.

4. The gate driving circuit of claim 2, wherein the fourth input signal is a compensation signal output from a next stage of the stage, among the plurality of stages.

5. The gate driving circuit of claim 2, wherein the stage of the plurality of stages further comprises:

an inverter which outputs a signal synchronized to a clock signal of the clock input end to a second node during a period other than a period during which the carry signal is output; and holding units which provide a back-bias voltage to the third output end in response to a signal output from the second node.

6. The gate driving circuit of claim 5, wherein the inverter comprises at least two transistors connected to the first voltage having a lower voltage level than a low level of the gate signals.

7. The gate driving circuit of claim 6, wherein each back gate electrode of the at least two transistors is biased by one of the back-bias voltage or the compensation signal.

8. The gate driving circuit of claim 5, wherein the inverter comprises:

a first inverter transistor connected to the first voltage having a lower voltage level than a low level of the gate signals; and a second inverter transistor connected to a second voltage having a same voltage level as the low level of the gate signals.

9. The gate driving circuit of claim 8, wherein a back gate electrode of the first inverter transistor is biased by one of the back-bias voltage and the compensation signal.

10. The gate driving circuit of claim 5, wherein the stage of the plurality of stages further comprises:

a first pull-down transistor comprising a control end connected to the third input end to receive the third input signal, a first end connected to the third output end, and a second end connected to the back-bias voltage.

11. The gate driving circuit of claim 5, wherein the holding units comprise:

a first holding transistor comprising a control end connected to the second node and connected through a third node between the back-bias voltage and the third output end; and a second holding transistor comprising a control end connected to the second node and connected through the third node between the back-bias voltage and the third output end, and the stage of the plurality of stages further comprises a fourth output transistor comprising a control end connected to the first node, a first end connected to the clock input end, and a second end connected to the third node.

12. The gate driving circuit of claim 1, wherein each of the first control transistor and the second control transistor further comprises:

an activation portion overlapping the control electrode;

an input electrode overlapping the activation portion; and an output electrode overlapping the activation portion, wherein the back gate electrode overlaps the control electrode and the activation portion, wherein the back gate electrode of the first control transistor receives the second input signal and the back gate electrode of the second control transistor receives the fourth input signal, which control threshold voltages of the first control transistor and the second control transistor.

13. The gate driving circuit of claim 1, wherein the first input signal and the second input signal have an enable level during a same period as each other, and the first input signal is transmitted to the first node through the first control transistor, a threshold voltage of which is lowered by the second input signal.

14. A display device comprising:

a display portion including a plurality of pixels connected to corresponding gate lines; and a gate driver including a plurality of stages which outputs gate signals to the corresponding gate lines, wherein a stage of the plurality of stages comprises:

a first control transistor diode-connected between a first input end of the stage and a first node, wherein the first control transistor has a double-gate structure having both a control electrode and a back gate electrode, the control electrode of the first control transistor is biased by a first input signal of the first input end of the stage and directly connected to the first input end of the stage, and the back gate electrode of the first control transistor is biased by a second input signal of a second input end of the stage;

a second control transistor comprising a first end connected to the first node, a second end connected to a first voltage, and a double-gate structure having both a control electrode and a back gate electrode, wherein the control electrode of the second control transistor is connected to a third input end of the stage and receives a third input signal, and the back gate electrode of the second control transistor is biased by a fourth input signal of a fourth input end of the stage;

a first output transistor comprising a control end connected to the first node, a first end connected to a clock input end of the stage, and a second end connected to a first output end of the stage; and a capacitor connected between the control end and the second end of the first output transistor, and wherein the second input signal and the fourth input signal have an enable level during different periods from each other.

15. The display device of claim 14, wherein the stage of the plurality of stages further comprises:

a second output transistor comprising a control end connected to the first node, a first end connected to the clock input end, and a second end connected to a second output end of the stage to output a carry signal; and a third output transistor comprising a control end connected to the first node, a first end connected to the clock input end, and a second end connected to a third output end of the stage to output a compensation signal, and a back gate electrode of the second output transistor is biased by the compensation signal.

16. A gate driving circuit comprising:

a plurality of stages which outputs gate signals to corresponding gate lines, wherein a stage of the plurality of stages comprises:

a first control transistor diode-connected between a first input end of the stage and a first node, wherein the first control transistor has a double-gate structure having both a control electrode and a back gate electrode, the control electrode of the first control transistor is biased by a first input signal of the first input end of the stage and directly connected to the first input end of the stage, and the back gate electrode of the first control transistor is biased by a second input signal of a second input end of the stage;

a second control transistor comprising a first end connected to the first node, and a second end connected to a first voltage, and a double-gate structure having both a control electrode and a back gate electrode, wherein the control electrode of the second control transistor is connected to a third input end of the stage and receives a third input signal, and the back gate electrode of the second control transistor is biased by a fourth input signal of a fourth input end of the stage;

a first output transistor comprising a control end connected to the first node, a first end connected to a clock input end of the stage, and a second end connected to a first output end of the stage;

a capacitor connected between the control end and the second end of the first output transistor;

a second output transistor comprising a control end connected to the first node, a first end connected to the clock input end, and a second end connected to a second output end of the stage to output a carry signal;

a first inverter transistor connected to the first voltage having a lower voltage level than a low level of the gate signals, where the first inverter transistor transmits the first voltage to a second node during a period during which the carry signal is output; and a second inverter transistor connected to a second voltage having a same voltage level as the low level of the gate signals, wherein the second inverter transistor is turned off during a period other than the period during which the carry signal is output, wherein the second input signal and the fourth input signal have an enable level during different periods from each other.

* * * * *